United States Patent [19]

Kawashima

[11] Patent Number: 4,991,484

[45] Date of Patent: Feb. 12, 1991

[54] TONE SIGNAL GENERATION DEVICE HAVING A SAMPLING FUNCTION

[75] Inventor: Susumu Kawashima, Hamamatsu, Japan

[73] Assignee: Yamaha Corporation, Hamamatsu, Japan

[21] Appl. No.: 292,751

[22] Filed: Jan. 3, 1989

[30] Foreign Application Priority Data

Jan. 6, 1988 [JP] Japan ..... 63-1083
Jan. 6, 1988 [JP] Japan ..... 63-1084

[51] Int. Cl.[5] ..... G10H 7/02; G10H 1/18

[52] U.S. Cl. ..... 84/603; 84/604; 84/607; 84/615; 84/622; 84/636; 84/454

[58] Field of Search ..... 84/DIG. 12, 1.01, 1.28, 84/1.13, 1.26, 1.03, 1.19, 1.27, 601–607, 610–612, 622, 615–617, 624, 625, 626, 470 R, 454, DIG. 18; 381/51, 62

[56] References Cited

U.S. PATENT DOCUMENTS

| | | | |
|---|---|---|---|
| 3,878,754 | 4/1975 | Barnum | 84/DIG. 18 |
| 3,952,625 | 4/1976 | Peterson | 84/454 |
| 4,281,577 | 8/1981 | Middleton | 84/454 |
| 4,321,853 | 3/1982 | Tumblin | 84/454 |
| 4,327,623 | 5/1982 | Mochida et al. | 84/1.01 X |
| 4,354,418 | 10/1982 | Moravec et al. | 84/454 |
| 4,369,687 | 1/1983 | Meyers | 84/454 |
| 4,461,199 | 7/1984 | Hiyoshi et al. | 84/1.19 |
| 4,506,580 | 3/1985 | Koike | 84/1.01 |
| 4,667,556 | 5/1987 | Hanzawa et al. | 84/1.28 X |
| B1 4,667,556 | 1/1989 | Hanzawa et al. | 84/1.28 X |
| 4,681,008 | 7/1987 | Morikawa et al. | 84/1.01 X |
| 4,696,214 | 9/1987 | Ichiki | 84/1.01 |
| 4,785,703 | 11/1988 | Ichiki | 84/1.03 |
| 4,785,707 | 11/1988 | Suzuki . | |
| 4,864,625 | 9/1989 | Hanzawa et al. | 84/603 X |

FOREIGN PATENT DOCUMENTS 0218912 4/1987 European Pat. Off. ..... 84/1.01

*Primary Examiner*—R. L. Moses
*Assistant Examiner*—Matthew S. Smith
*Attorney, Agent, or Firm*—Spensley Horn Jubas & Lubitz

[57] ABSTRACT

There are provided a device for sampling a tone signal applied from outside, a built-in tone source, responsive to tone pitch information, a tone signal having tone pitch corresponding to the tone pitch of the tone pitch information, a memory capable of both writing and reading for storing waveform sampled data and a control circuit for selectively writing a tone signal sampled or a tone signal generated from the built-in tone source. The waveform sampled data in the memory is read out in accordance with designated tone pitch. A circuit is provided which, when input of a tone signal sampled has not been detected for a predetermined period, causes a tone signal generated from the built-in tone source and written in the memory. There is also provided a circuit which generates a tone of a reference pitch when a predetermined switch operation has been made with the tuning operation. There is also provided a circuit for selecting whether pitch adjustment should be made in both a sample tone source having a memory storing a tone signal sampled and the built-in tone source or the pitch adjustment should be made only in the sampled tone source. There are provided a circuit for generating pattern data designating tone sounding timing and tone pitch in accordance with a rhythm pattern and a circuit for performing selection as is whether the sampled tone source be driven in accordance with this pattern data or in accordance with a key depression.

18 Claims, 12 Drawing Sheets

TONE SIGNAL GENERATION DEVICE HAVING A SAMPLING FUNCTION

BACKGROUND OF THE INVENTION

The present invention relates to a tone signal generation device of a sampling system type which samples a tone signal applied from outside and stores it in a memory and generates a tone signal by reading out waveform sampled data stored in this memory at a desired tone pitch by key operation or the like operation and, more particularly, to a tone signal generation device having a built-in tone source and being capable of storing either a tone signal generated from this built-in tone source or a sampled tone signal from outside selectively in the memory and thereby being capable of treating the tone signal generated from the built-in tone source in the same manner as the sampled tone signal from outside.

The present invention relates also to a tone signal generation device of a sampling system type capable of storing a tone signal from a built-in tone source when a tone signal from outside has not been applied for a predetermined period of time after designation of sampling of a tone signal from outside.

The present invention further relates to a tone signal generation device of a sampling system type having various functions.

As electronic musical instruments of a sampling system type, there are ones such as disclosed in Japanese Patent Publication Nos. 33199/1986 and 47435/1986. In these prior art electronic musical instruments of a sampling system type, a tone signal from outside is merely sampled and stored in a memory and, even if there is a tone source in the electronic musical instrument, a tone signal from this internal tone source cannot be stored in the memory for sampling. Accordingly, a tone signal from the internal tone source cannot be subjected to the same processings, i.e., sampled tone editing processings, as are applied to a tone signal sampled from outside. The sampled tone editing processings herein mean processings including ones according to which a sampled tone is sounded repeatedly and reading of a sampled tone from the memory is made by reading addresses in a reverse direction.

In a case where waveform sampled data of a tone signal sampled from outside is written in a memory, write address of the memory generally changes at a predetermined reference rate (e.g., tone pitch of A4 tone). If this memory is accessed with an address signal which changes in accordance with the same reference rate, waveform sampled data is read out from the memory and sounded at the same tone pitch as the tone pitch of the sampled external tone. Further, by changing the rate of the read address signal in accordance with a desired tone pitch, a tone signal corresponding to the sampled external tone can be sounded at a desired tone pitch corresponding to the read rate.

On the other hand, it has been conceived that, in a case where a tone signal from outside is sampled, selection is made as to whether the sampled tone signal should be used in a part of bass tones or in a part of normal tone range such as melody or chord. In this case, the prior art tone generation device is so constructed that a tone signal sampled from outside is written in a memory as it is at a predetermined reference rate.

In the above described prior art electronic musical instrument of a sampling system type, a tone signal from outside is merely sampled and stored in a memory and, accordingly, even if there is an internal tone source in the electronic musical instrument, a tone signal from this internal tone source cannot be stored in the memory for sampling so that the tone signal from the internal tone source cannot be subjected to the same processings, i.e., the sampled tone editing processings, as are applied to the tone signal sampled from outside. The prior art device is therefore disadvantageous in that it cannot utilize functions of the electronic musical instrument of a sampling system type to the fullest extent.

Besides, the prior art electronic musical instrument is not so adapted that a write control of a sampled tone is performed having regard to a performance part in which the sampled tone signal is used and, accordingly, a sampled tone of a part of lower tone range such as bass tones and a sampled tone of a part of a normal tone range are sometimes written in a memory at the same tone pitch. This necessitates capability of a read control circuit to cope with a broader tone range for enabling a tone to be sounded in sufficiently broad tone range during reading and performance of a tone with resulting complication in the circuit design.

In a case where an external tone signal has not been applied or sampled due to some reason (e.g., erroneous operation in sampling the external tone, disorder of a microphone, failure in inputting of the external tone, or interruption of the external tone sampling operation by leaving of the performer from his seat) notwithstanding that the performer has designated sampling of the external tone signal by operation of a switch or the like means, the prior art device maintains a standby state to receive an external tone signal. This is because an external tone must be always sampled for a sampled tone to be sounded during performance.

In the electronic musical instrument of a sampling system, as described above, if an external tone signal has not been applied or sampled for some reason notwithstanding that sampling of the external tone signal has once been designated, a standby state to receive an external tone signal is maintained indefinitely. Therefore, when the performer who is not aware of this erroneous operation or who has returned to his seat after leaving it starts to play on the keyboard, a tone sometimes is not sounded despite depression of a key because the tone has not been sampled in the memory yet. Moreover, the performer tends to misunderstand this state in which the tone is not sounded despite depression of the key to be a disorder of the device.

SUMMARY OF THE INVENTION

It is, therefore, an object of the present invention to provide a tone signal generation device capable of sampling not only a tone signal from outside but also a tone signal generated from a built-in tone source for storing it in a memory for a sampled tone whereby the sampling function of the device is expanded.

It is another object of the present invention to provide a tone signal generation device in which, when a tone signal generated by a built-in tone source is sampled and stored in a memory for sampled tones, write control of a sampled tone is performed having regard to a performance part in which the sampled tone is used in such a manner that a sampled tone in a part of lower tone range such as bass tones (or, conversely, a part of higher tone range) is written in the memory at a lower tone pitch than a sampled tone in a part of a normal tone range (or, conversely, at a higher tone pitch) whereby a tone can be generated in a sufficiently broad tone range proper to a performance part selected during reading and performance even if the read control circuit is of a simple construction suitable for use in a relatively narrow tone range.

It is another object of the present invention to provide a tone signal generation device which is capable of automatically sampling a tone signal generated from a built-in tone source in a memory when a tone signal from outside has not been applied for a predetermined period of time after designation of sampling of an external tone thereby releasing the device from a sampled tone standby mode and bringing about a mode in which the device can generate a tone.

It is another object of the present invention to provide a tone signal generation device in which, when a pitch adjustment operation such as tuning is made, a tone of a predetermined reference pitch can be sounded by operation of a switch in association with the pitch adjustment operation whereby the pitch adjustment can be facilitated.

It is another object of the present invention to provide a tone signal generation device in which, when a pitch adjustment operation such as transposition is made, whether the pitch adjustment operation is made in both a sampled tone source including a memory storing a tone signal sampled from outside and a built-in tone source or the pitch adjustment operation is made in only the sampled tone source can be selected.

It is still another object of the present invention to provide a tone signal generation device which can, for realizing multi-purpose utilization of a sampled tone source, perform control selectively as to whether a sampled tone source is driven in accordance with pattern data designating tone sounding timing and tone pitch or in accordance with tone pitch designation by depression of a key or the like means.

The tone signal generation device according to the present invention comprises tone sampling means for sampling a tone signal applied form outside, built-in tone source means responsive to tone pitch information for generating a tone signal having the tone pitch corresponding to the tone pitch of the tone pitch information, memory means capable of both writing and reading for storing waveform sampled data, write control means for selecting one of waveform sampled data of a tone signal sampled by said tone sampling means and waveform sampled data of a tone signal generated by said built-in tone source means and writing the selected waveform sampled data to said memory means, tone pitch designation means for designating tone pitch of a tone to be generated, and read control means for reading out the waveform sampled data from said memory means in accordance with the tone pitch designated by said tone pitch designation means, said tone signal generation device generating a tone signal corresponding to the waveform sampled data read out from said memory means.

If a tone signal applied from outside is to be sampled and written in the memory means, by the control of the write control means, waveform sampled data of a tone signal sampled by the tone sampling means is selected and written in the memory means. If, on the other hand, a tone signal generated by the built-in tone source means is to be sampled and written in the memory means, by the control of the write control means, waveform sampled data of a tone signal generated by the built-in tone source means is selected and written in the memory means. In this manner, one of the waveform sampled data of the tone signal applied from outside and the waveform sampled data of the tone signal generated by the built-in tone source means can be selected and written in the memory means. By this arrangement, the same processing which is applied to a tone signal sampled from outside and stored in the memory means, i.e., the sampled tone editing processings etc. can be applied also to a tone signal from the built-in tone source. In other words, the function as the tone signal generation device of a sampling system type can be performed with respect also to a tone signal generated by the built-in tone source.

In one aspect of the present invention, the tone signal generation device is characterized in that it comprises allocation setting means for setting at least one of a first part having a normal tone range and a second part having a tone range whose main tone range is different from the tone range of the first part as a part to which the waveform sampled data stored in said memory means should be allocated as tone source data, tone pitch information supply means for supplying the tone pitch information to said built-in tone source means in such a manner that, when the waveform sampled data of said memory means is allocated to said second part in accordance with setting by said allocation setting means, said tone pitch information supply means supplies tone pitch information which is different by a predetermined note interval from tone pitch information supplied when the waveform sampled data is allocated to said first part, the tone pitch of a tone signal generated by said built-in tone source means and written in said memory means being different by the predetermined note interval when the waveform sampled data is allocated to said second part from the tone pitch generated when the waveform sampled data is allocated to said first part and, as a result, when the waveform sampled data is allocated to said second part, tone pitch of a tone signal corresponding to waveform sampled data read out from said memory means in accordance with the tone pitch designated by said tone pitch designation means is different by the predetermined note interval from the designated tone pitch.

The allocation setting means can be used to determine which of the first part of the normal tone range and the second part whose main tone range is different from the tone range of the first part the waveform sampled data stored in the memory means should be allocated. The tone pitch supply means supplies the tone pitch information to the built-in tone source means in a manner to supply different tone pitch information depending upon setting by the allocation setting means.

By way of example, the second part is a part of bass tones and, when the waveform sampled data of the memory means is allocated to the part of bass tones, the tone pitch information supply means supplies tone pitch information which is lower by a predetermined note interval than when the waveform sampled data is allocated to the part of the normal tone range. By this arrangement, the tone pitch of a tone signal generated by the built-in tone source means and written in the memory means is lower by the predetermined note interval when the waveform sampled data is allocated to the part of bass tones than when the waveform sampled data is allocated to the part of the normal tone range and, as a result, when the waveform sampled data is allocated to the part of bass tones, tone pitch of a tone signal corresponding to waveform sampled data read out from the memory means in accordance with the tone pitch designated by the tone pitch designation means is lower by the predetermined note interval than the designated tone pitch.

If, for example, waveform sampled data stored in the memory means is allocated to the part of the normal tone range, tone pitch information of a predetermined reference tone pitch (e.g., A4 tone) is supplied to the built-in tone source means to cause the built-in tone source means to generate a tone signal of the reference tone pitch and this tone signal is written in the memory means in accordance with the control of the write control means. On the other hand, if waveform sampled data stored in the memory is allocated to the part of bass tones, tone pitch information (e.g., A3 tone) which is lower by a predetermined note interval (e.g., one octave) than the reference tone pitch is supplied to the built-in tone source means to cause the built-in tone source to generate a tone signal of a tone pitch which is lower by the predetermined note interval than the reference tone pitch in response to the tone pitch information and this tone signal is written in the memory means by the control of the write control means. In this case, it is assumed that the write rate is the same in both instances (e.g., a rate corresponding to change of the address signal of A4 tone).

In this case, during reading, tone pitch of a tone signal corresponding to waveform sampled data read out from the memory means with respect to the same read address change rate is lower by the predetermined note interval (e.g., one octave) in the case of a tone signal corresponding to the waveform sampled data allocated to the part of bass tones than in the case of a tone signal corresponding to the waveform sampled data allocated to the part of the normal tone range. If, for example, the waveform sampled data is read out at the reference rate of A4 tone, a tone signal corresponding to the waveform sampled data allocated to the part of the normal tone range is of the same tone pitch of A4 whereas a tone signal corresponding to the waveform sampled data allocated to the part of bass tones is of tone pitch of A3 which is lower by one octave than the reference tone pitch.

What is meant by the foregoing is that notwithstanding that the tone pitch designation means which designates tone pitch of a tone to be generated is not so constructed as to designate a sufficiently low tone range for bass tones and, accordingly, the read control means is not so constructed as to designate an address in a sufficiently low tone range for bass tones, waveform sampled data allocated to the part of bass tones can be read out from the memory means at a tone pitch which is sufficiently low for bass tones. Even if, for example, the range of tone pitch designation in the tone pitch designation means and read address generation in the read control means is only three octaves from C3–B5, waveform sampled data allocated to the part of bass tones can be read out from the memory means at a tone pitch in a tone range of C2–B2 which is one octave lower.

Thus, internal sampled tones allocated to the part of bass tones can be generated in a sufficiently low tone range during reading and performance notwithstanding that the tone designation means and the read control means are of a simple construction corresponding to a relatively narrow tone range.

When the main tone range of the second part is a higher tone range than the normal range, the same function can be performed by reversing the direction of difference in the predetermined note interval from the above described case.

In the above construction, the tone pitch of a tone signal generated by the built-in tone source is different depending upon whether the waveform sampled data stored in the memory means is allocated to the first part or the second part. The same purpose can also be attained by the following construction.

Another tone signal generation device according to the present invention is characterized in that it comprises allocation setting at least means for setting one of a first part having a normal tone range and a second part having a tone range whose main tone range is different from the tone range of the first part as a part to which the waveform sampled data stored in said memory means should be allocated as tone source data, write rate designation means for designating write rate for writing a waveform sampled data of a tone signal generated by said built-in tone source means in said memory means in such a manner that, when the waveform sampled data of said memory means is allocated to said second part in accordance with setting by said allocation setting means, said write rate designation means designates a write rate which is different by a predetermined note interval from a reference write rate designated when the waveform sampled data is allocated to said first part, and, as a result, when the waveform sampled data of said memory means is allocated to said second part, tone pitch of a tone signal corresponding to waveform sampled data read out from said memory means in accordance with the tone pitch designated by said tone pitch designation means is different by the predetermined note interval from the designated tone pitch.

If, for example, the second part is a part for bass tones, the write rate designation means designates, when waveform sampled data of the memory means is allocated to the part of bass tones, a write rate which is higher by a predetermined note interval than the reference write rate used when the waveform sampled data is allocated to the part of the normal tone range. As a result, when the waveform sampled data of the memory means is allocated to the part of bass tones, tone pitch of a tone signal corresponding to waveform sampled data read out from the memory means in accordance with the tone pitch designated by the tone pitch designation means is lower by the predetermined note interval than the designated tone pitch.

If, for example, waveform sampled data of the memory means is allocated in the part of the normal tone range, the reference write rate (e.g., a rate corresponding to change of an address signal for A4 tone) is designated whereas if waveform sampled data is allocated to the part of bass tones, a write rate which is higher by a predetermined note interval (e.g., one octave) than the reference write rate is designated. In this case, it is assumed that the built-in tone source means generates a tone signal of the reference tone pitch in accordance with tone pitch information of the same reference tone pitch (e.g., A4 tone) in both cases.

In this case, during reading, tone pitch of a tone signal corresponding to waveform sampled data read out from the memory means with respect to the same read address change rate is, in the same manner as above, lower by the predetermined note interval (e.g., one octave) in the case of a tone signal corresponding to the waveform sampled data allocated to the part of bass tones than in the case of a tone signal corresponding to the waveform sampled data allocated to the part of the normal tone range. If, for example, the waveform sampled data is read out at the reference rate of A4 tone, a tone signal corresponding to the waveform sampled data allocated to the part of the normal tone range is of the same tone pitch of A4 tone whereas a tone signal corresponding to the waveform sampled data allocated to the part of bass tones is of a tone pitch of A3 which is one octave lower than the reference tone pitch.

Thus, in the case of controlling the write rate by the write rate designation means also, an internal sampled tone allocated to the part of bass tones can be generated in a sufficiently low tone range during reading and performance notwithstanding that the tone pitch designation means and the read control means are of a simple construction adapted for a relatively narrow tone range. In this case also, if the main tone range of the second part is higher than the normal tone range, the same function can be performed by reversing the direction of difference in the predetermined note interval from the case described above.

As will be apparent from the foregoing description, it is also possible to combine the control of tone pitch of a tone generated in the built-in tone source by the tone pitch information supply means and the control of the write rate by the write rate designation means.

In one aspect of the invention, the tone signal generation device comprises a tone signal input means for receiving a tone signal from outside, built-in tone source means responsive to information which designates generation of a tone for generating a tone signal, memory means capable of both writing and reading for storing waveform sampled data of a tone signal received through said tone signal input means or waveform sampled data of a tone signal generated by said built-in tone source means, sampling demand means for demanding inputting of a tone signal from said tone signal input means and writing waveform sampled data of the input tone signal in said memory means, rise detection means for detecting rising of the tone signal received through said tone signal input means, sampling control means for designating, when rise of the tone signal has not been detected by said rise detection means within a predetermined period of time from the demand of writing of the waveform sampled data by said sampling demand means, generation of a tone signal from said built-in tone source means and writing of waveform sampled data of the generated tone signal in said memory means, and read means for reading out the waveform sampled data stored in said memory means and thereby generating a tone signal corresponding to the read out waveform sampled data.

Upon designation by the sampling designation means of inputting of a tone signal from the tone signal input means and writing of waveform sampled data of the input tone signal in the memory means, the sampling control means starts counting of a predetermined period of time and during the counting, the rise detection means examines whether there has been rise of a tone signal or not. If rise of a tone signal from the tone signal input means has been detected, waveform sampled data is stored in the memory means as usual. If rise of a tone signal from the tone signal input means has not been detected during the predetermined period of time, the sampling control means designates generation of a tone signal from the built-in tone source means and writing of waveform sampled data of the generated tone signal in the memory means.

Thus, when an external tone signal has not been applied for a predetermined period of time after starting of sampling of an external tone, the tone sampling mode is automatically changed to a mode in which a tone signal generated by the built-in tone source means is sampled and stored in the memory means (internal tone sampling mode). By this arrangement, if an external tone signal has not been sampled in the memory means for some reason notwithstanding that sampling of an external tone has been designated, the tone sampling mode is automatically changed to the internal tone sampling mode and a tone signal is stored in the memory means. Accordingly, when a performer who is not aware of his erroneous operation or failure in sampling of an external tone starts playing on the keyboard for the purpose of performing a sampled tone, a tone can be generated without any problem by depressing a key on the keyboard and, as a result, misunderstanding as to disorder of the device will not occur and performance of a sampled tone will be made without trouble.

In one aspect of the invention, the tone signal generation device according to the invention comprises tone generation means for generating a tone signal, pitch adjusting operator means for adjusting pitch of a tone signal generated by said tone generation means, pitch adjustment control means for enabling pitch adjustment to be made by said tone generation means in response to operation of said pitch adjusting operator means, reference tone generation means for generating a reference tone signal having a predetermined reference pitch, selection switch means for selecting whether this reference tone signal should be sounded or not, detection means for detecting operation of said pitch adjusting operator means in association with operation of said selection switch, and tone sounding control means responsive to detection by said detection means for automatically generating the reference tone signal from said reference tone generation means and sounding the generated reference tone.

If sounding of a reference tone is selected by operating the selection switch means while the pitch adjustment operation is made by the pitch adjusting operator means, a reference tone signal is automatically generated from the reference tone generation means by the control of the tone sounding control means. By this arrangement, the pitch adjustment operation of a tone signal generated by the tone generation means can be performed by the pitch adjusting operator means while the reference tone is confirmed in hearing so that an accurate pitch adjustment can be ensured. Accordingly, this construction is suited to tuning or transposition of the tone generation means. When the tone generation means is a sampled tone source, this construction is particularly useful because the pitch of a tone sampled from outside is adjusted to a pitch which is standardized for musical instruments. When a tone signal is generated and sounded from the tone generation means under pitch adjustment, the tone signal under pitch adjustment may be always sounded or may be sounded only during at least sounding of the reference tone. When the tone signal under pitch adjustment and the reference tone are sounded simultaneously, the two tones need not be sounded entirely simultaneously in an overlapping manner but may be sounded alternately.

In one aspect of the present invention, the tone signal generation device comprises tone sampling means for sampling a tone signal applied from outside, sampled tone source means having memory means for storing waveform sampled data corresponding to the tone signal sampled by said tone sampling means for generating a tone signal on the basis of the waveform sampled data stored in said memory means, built-in tone source means consisting of a prepared tone source, pitch adjusting operator means, mode selection means for selecting one of a first mode in which pitch adjustment is made by both said sampled tone source means and said built-in tone source means and a second mode in which pitch adjustment is made by only said sampled tone source means, and pitch adjustment control means for performing pitch adjustment in such a manner that, when the first mode has been selected, pitch adjustment is made in both said sampled tone source means and said built-in tone source means in response to operation of said pitch adjusting operator means and, when the second mode has been selected, pitch adjustment is made in only said sampled tone source means in response to operation of said pitch adjusting operator means.

If the first mode is selected by the mode selection means, pitch adjustment is made in response to operation of the pitch adjusting operator means both in the sampled tone source means and the built-in tone source means. If the second mode is selected, the pitch adjustment is made in response to the operation of the pitch adjusting operator means only in the sampled tone source means. Since the pitch of the external tone stored in the sampled tone source means is not necessarily a reference pitch, the second mode is very useful when necessary transposition is made by making pitch adjustment in only the sampled tone source means in response to the operation of the pitch adjusting operator means. If transposition is made during performance, it is preferable to perform pitch adjustment (transposition) of the same amount in both the sampled tone source means and the built-in tone source means together so that it is proper to select the first mode.

In another aspect of the present invention, the tone signal generation device comprises tone sampling means for sampling a tone signal applied from outside, sampled tone source means having memory means for storing waveform sampled data corresponding to the tone signal sampled by said tone sampling means for generating a tone signal on the basis of the waveform sampled data stored in said memory means, tempo signal generation means, rhythm pattern generation means for generating rhythm pattern data in response to the tempo signal generated by said tempo signal generation means, rhythm tone source means for generating a rhythm tone signal in response to the rhythm pattern data generated by said rhythm pattern generation means, sampled tone pattern generation means responsive to the tempo signal generated by said tempo signal generation means for generating pattern data designating tone sounding timing and tone pitch of a tone signal to be generated in said sampled tone source means, and control means for performing control as to whether or not a tone signal should be generated from said sampled tone source means at the tone sounding timing and at the tone pitch in accordance with the pattern data generated by said sampled tone pattern generation means.

By the control by the control means, the sampled tone source means can be used as a tone source of an extra percussion tone. By the control by the control means, a tone signal is generated from the sampled tone source means at a tone sounding timing and tone pitch in accordance with pattern data generated by the sampled tone pattern generation means and this tone signal is sounded as the extra percussion tone.

In one aspect of the present invention, the tone signal generation device comprises tone sampling means for sampling a tone signal applied from outside, sampled tone source means having memory means for storing waveform sampled data corresponding to the tone signal sampled by said tone sampling means for generating a tone signal on the basis of the waveform sampled data stored in said memory means, tempo signal generation means, sampled tone pattern generation means responsive to the tempo signal generated by said tempo signal generation means for generating pattern data designating tone sounding timing and tone pitch of a tone signal to be generated in said sampled tone source means, tone pitch designation means for designating tone pitch of a tone to be generated, and control means for controlling which output of said sampled tone pattern generation means and said tone pitch designation means should be used for driving said sampled tone source means.

By this arrangement, the sampled tone source means can be used for many purposes such as a tone source of an extra percussion tone and a tone source for generating a tone in response to a tone pitch designation operation of the tone pitch designation means such as a keyboard whereby multi-purpose utilization of the sampled tone source can be realized.

A device for generating an automatic bass/chord performance pattern may further be provided and the sampled tone source means may be driven in response to both the tone pitch designation operation by the tone pitch designation means and the automatic bass pattern or automatic chord pattern. In the embodiment described below, when the automatic bass/chord performance has been turned off while a selected performance mode is one in which the sampled tone source is driven in response to both the tone pitch designation operation in the keyboard and the automatic bass pattern, the sampled tone source is used as a tone source of an extra percussion tone.

Embodiments of the present invention will now be described with reference to the accompanying drawings.

BRIEF DESCRIPTION OF THE DRAWINGS

In the accompanying drawings,

FIGS. 5 through 21 are flow charts showing an example of a program executed in the microcomputer section of FIG. 2 in which FIG. 5 shows a main routine;

FIGS. 6–20 show various event routines executed in the process of the main routine and FIG. 21 shows a tempo clock interrupt routine.

DESCRIPTION OF PREFERRED EMBODIMENTS

Figure 1A:
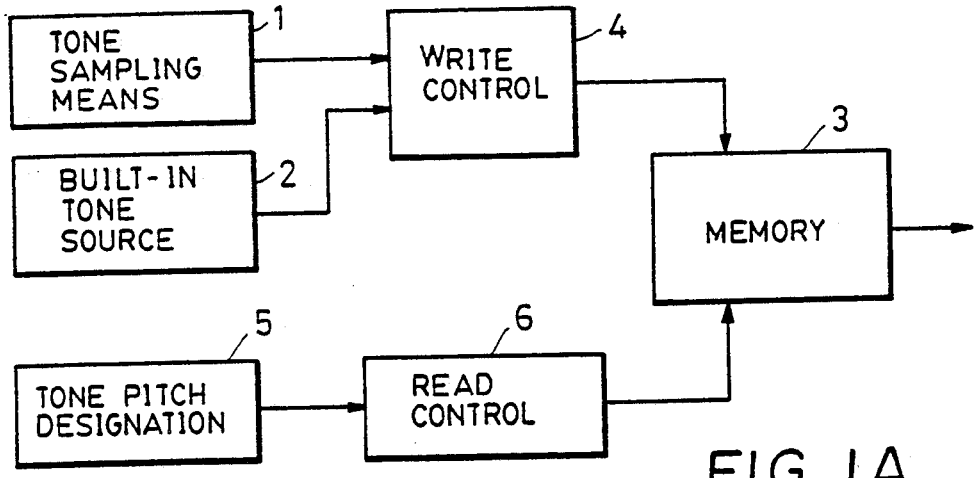
FIGS. 1A–1H are functional block diagrams showing schematically the tone signal generation device according to the present invention.

A tone signal generation device shown in FIG. 1A comprises:

tone sampling means 1 for sampling a tone signal applied from outside;

built-in tone source means 2 responsive to tone pitch information for generating a tone signal having tone pitch corresponding to the tone pitch of the tone pitch information;

memory means 3 capable of both writing and reading for storing waveform sampled data;

write control means 4 for selecting one of waveform sampled data of a tone signal sampled by said tone sampling means 1 and waveform sampled data of a tone signal generated by said built-in tone source means 2 and writing the selected waveform sampled data to said memory means 3;

tone pitch designation means 5 for designating tone pitch of a tone to be generated; and read control means 6 for reading out the waveform sampled data from said memory means 3 in accordance with the tone pitch designated by said tone pitch designation means 5;

said tone signal generation device generating a tone signal corresponding to the waveform sampled data read out from said memory means 3.

Figure 1B:
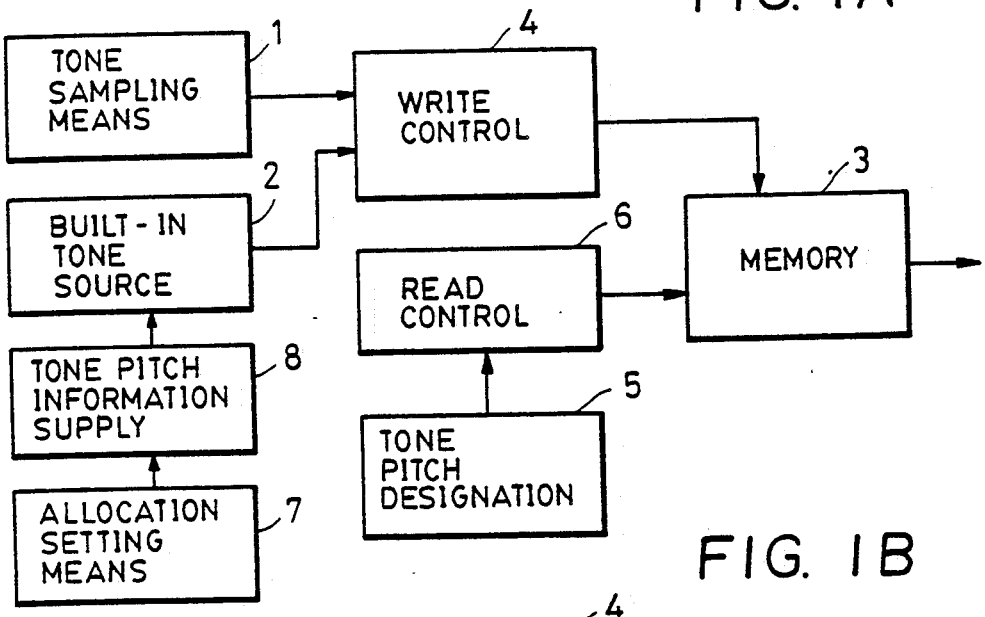

The tone signal generation device according to the present invention shown in FIG. 1B comprises:

allocation setting means 7 for setting at least one of a first part having a normal tone range and a second part having a tone range whose main tone range is different from the tone range of the first part as a part to which the waveform sampled data stored in said memory means 3 should be allocated as tone source data;

tone pitch information supply means 8 for supplying the tone pitch information to said built-in tone source means 2 in such a manner that, when the waveform sampled data of said memory means 3 is allocated to said second part in accordance with setting by said allocation setting means 7, said tone pitch information supply means 8 supplies tone pitch information which is different by a predetermined note interval from tone pitch information supplied when the waveform sampled data is allocated to said first part;

tone pitch of a tone signal generated by said built-in tone source means 2 and written in said memory means 3 being different by the predetermined note interval when the waveform sampled data is allocated to said second part from the tone pitch generated when the waveform sampled data is allocated to said first part and, as a result, when the waveform sampled data is allocated to said second part, tone pitch of a tone signal corresponding to waveform sampled data read out from said memory means 3 in accordance with the tone pitch designated by said tone pitch designation means 5 is different by the predetermined note interval from the designated tone pitch.

Figure 1C:
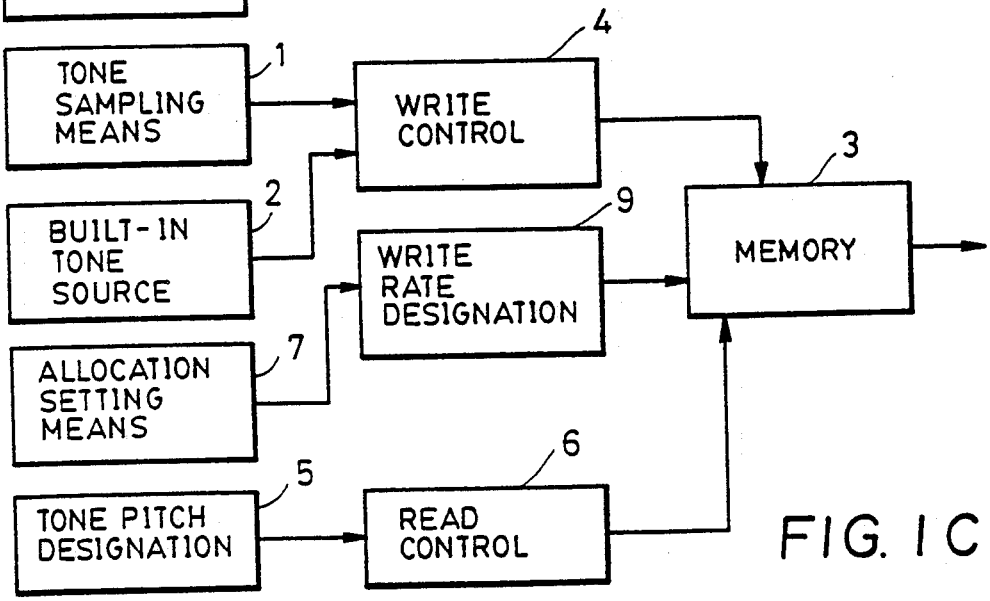

The tone signal generation device according to the invention shown in FIG. 1C comprises:

allocation setting means 7 for setting at least one of a first part having a normal tone range and a second part having a tone range whose main tone range is different from the tone range of the first part as a part to which the waveform sampled data stored in said memory means 3 should be allocated as tone source data;

write rate designation means 9 for designating write rate for writing a waveform sampled data of a tone signal generated by said built-in tone source means 2 in said memory means 3 in such a manner that, when the waveform sampled data of said memory means 3 is allocated to said second part in accordance with setting by said allocation setting means 7, said write rate designation means 9 designates a write rate which is different by a predetermined note interval from a reference write rate designated when the waveform sampled data is allocated to said first part, and as a result, when the waveform sampled data of said memory means 3 is allocated to said second part, tone pitch of a tone signal corresponding to waveform sampled data read out from said memory means 3 in accordance with the tone pitch designated by said tone pitch designation means 5 is different by the predetermined note interval from the designated tone pitch.

Figure 1D:
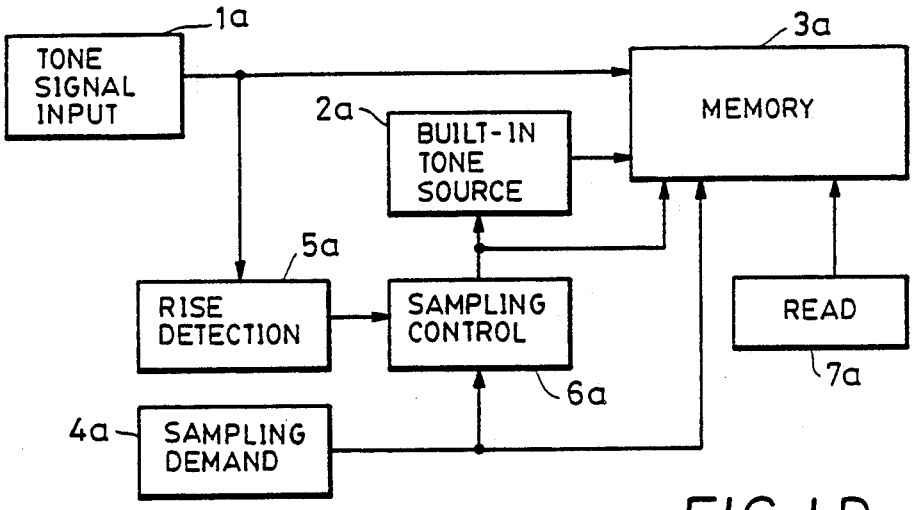

The tone signal generation device according to the present invention shown in FIG. 1D comprises:

a tone signal input means **1*a*** for receiving a tone signal from outside;

built-in tone source means **2*a*** responsive to information which designates generation of a tone for generating a tone signal;

memory means **3*a* capable of both writing and reading for storing waveform sampled data of a tone signal received through said tone signal input means 1*a* or waveform sampled data of a tone signal generated by said built-in tone source means 2*a*;**

sampling demand means **4*a* for demanding inputting of a tone signal from said tone signal input means 1*a* and writing waveform sampled data of the input tone signal in said memory means 3*a*;**

rise detection means **5*a* for detecting rising of the tone signal received through said tone signal input means 1*a*;**

sampling control means **6*a* for designating, when rise of the tone signal has not been detected by said rise detection means 5*a* within a predetermined period of time from the demand of writing of the waveform sampled data by said sampling demand means 4*a*, generation of a tone signal from said built-in tone source means 2*a* and writing of waveform sampled data of the generated tone signal in said memory means 3*a*; and read means 7*a* for reading out the waveform sampled data stored in said memory means 3*a*** and thereby generating a tone signal corresponding to the read out waveform sampled data.

Figure 1E:
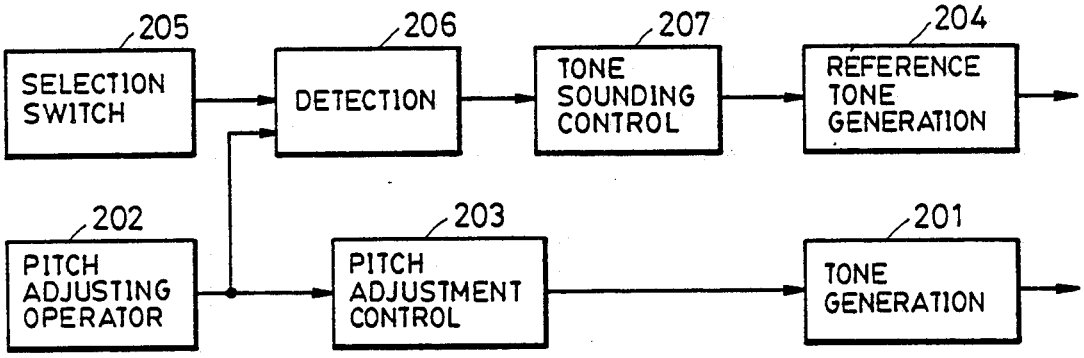

The tone signal generation device according to the present invention shown in FIG. 1E comprises:

tone generation means 201 for generating a tone signal;

pitch adjusting operator means 202 for adjusting pitch of a tone signal generated by said tone generation means 201;

pitch adjustment control means 203 for enabling pitch adjustment to be made by said tone generation means 201 in response to operation of said pitch adjusting operator means 202;

reference tone generation means 204 for generating a reference tone signal having a predetermined reference pitch;

selection switch means 205 for selecting whether this reference tone signal should be sounded or not;

detection means 206 for detecting operation of said pitch adjusting operator means 202 in association with operation of said selection switch 205; and tone sounding control means 207 responsive to detection by said detection means 206 for automatically generating the reference tone signal from said reference tone generation means 204 and sounding the generated reference tone.

Figure 1F:
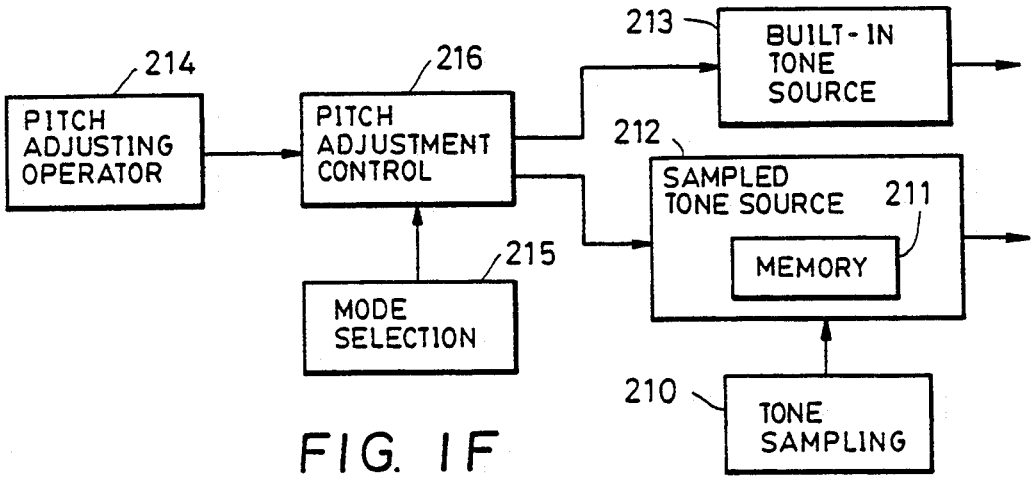

The tone signal generation device according to the present invention shown in FIG. 1F comprises:

tone sampling means 210 for sampling a tone signal applied from outside;

sampled tone source means 212 having memory means 211 for storing waveform sampled data corresponding to the tone signal sampled by said tone sampling means 210 for generating a tone signal on the basis of the waveform sampled data stored in said memory means 211;

built-in tone source means 213 consisting of a prepared tone source;

pitch adjusting operator means 214;

mode selection means 215 for selecting one of a first mode in which pitch adjustment is made by both said sampled tone source means 212 and said built-in tone source means 213 and a second mode in which pitch adjustment is made by only said sampled tone source means 212; and pitch adjustment control means 216 for performing pitch adjustment in such a manner that, when the first mode has been selected, pitch adjustment is made in both said sampled tone source means 212 and said built-in tone source means 213 in response to operation of said pitch adjusting operator means 214 and, when the second mode has been selected, pitch adjustment is made in only said sampled tone source means 212 in response to operation of said pitch adjusting operator means 214.

Figure 1G:
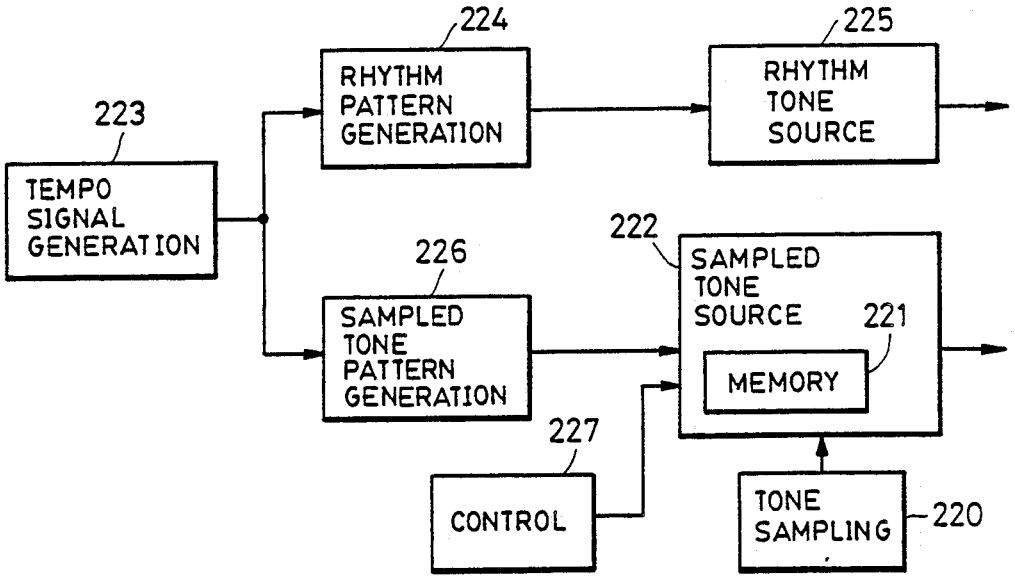

The tone signal generation device according to the present invention shown in FIG. 1G comprises:

tone sampling means 220 for sampling a tone signal applied from outside;

sampled tone source means 222 having memory means 221 for storing waveform sampled data corresponding to the tone signal sampled by said tone sampling means 220 for generating a tone signal on the basis of the waveform sampled data stored in said memory means 221;

tempo signal generation means 223;

rhythm pattern generation means 224 for generating rhythm pattern data in response to the tempo signal generated by said tempo signal generation means 223;

rhythm tone source means 225 for generating a rhythm tone signal in response to the rhythm pattern data generated by said rhythm pattern generation means 224;

sampled tone pattern generation means 226 responsive to the tempo signal generated by said tempo signal generation means 223 for generating pattern data designating tone sounding timing and tone pitch of a tone signal to be generated in said sampled tone source means 222; and control means 227 for performing control as to whether or not a tone signal should be generated from said sampled tone source means 222 at the tone sounding timing and at the tone pitch in accordance with the pattern data generated by said sampled tone pattern generation means 226.

Figure 1H:
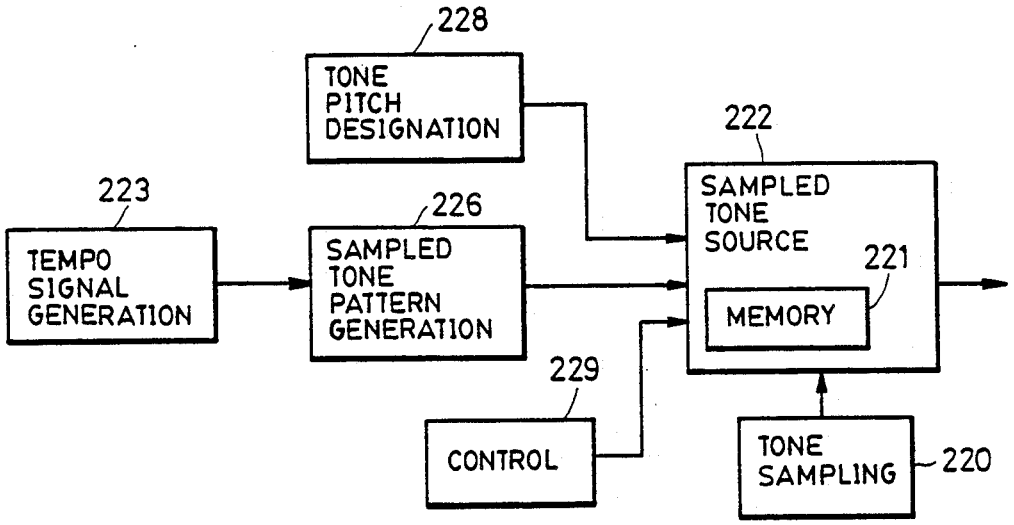

The tone signal generation device according to the present invention shown in FIG. 1H comprises:

tone sampling means 220 for sampling a tone signal applied from outside;

sampled tone source means 222 having memory means 221 for storing waveform sampled data corresponding to the tone signal sampled by said tone sampling means 220 for generating a tone signal on the basis of the waveform sampled data stored in said memory means 221;

tempo signal generation means 223;

sampled tone pattern generation means 226 responsive to the tempo signal generated by said tempo signal generation means 223 for generating pattern data designating tone sounding timing and tone pitch of a tone signal to be generated in said sampled tone source means 222;

tone pitch designation means 228 for designating tone pitch of a tone to be generated; and control means 229 for controlling which output of said sampled tone pattern generation means 226 and said tone pitch designation means 228 should be used for driving said sampled tone source means 222.

The operations of the tone signal generation device according to the present invention shown schematically in FIGS. 1A–1H have been described in Summary of the Invention above so that description thereof will be omitted.

Figure 2:
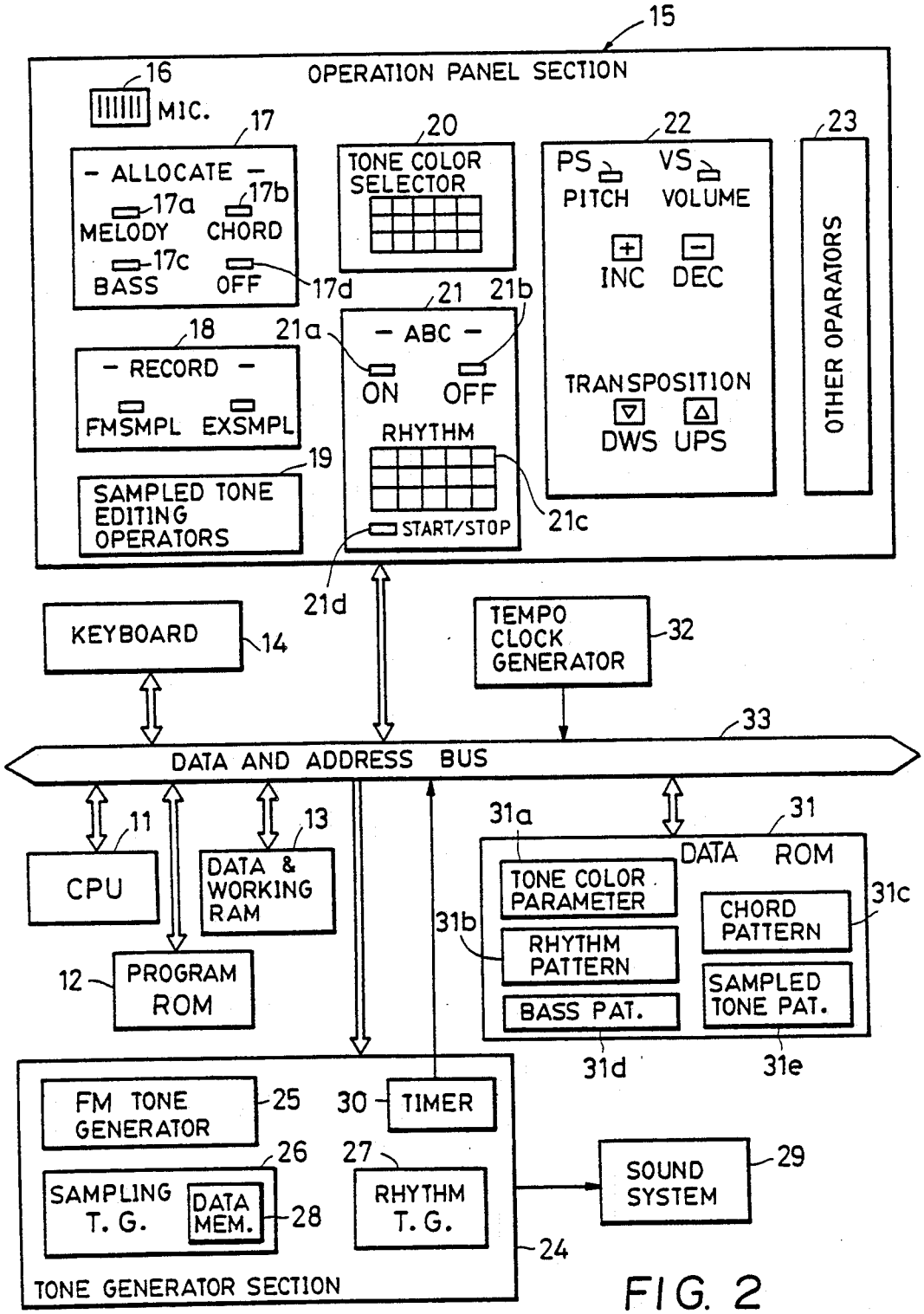
FIG. 2 is a diagram of a hardware construction showing an embodiment of an electronic musical instrument incorporating the tone signal generation device according to the present invention.

Referring now to FIG. 2 and subsequent figures, embodiments of the tone signal generation device according to the present invention will now be described more specifically.

FIG. 2 shows a hardware construction of an embodiment of an electronic musical instrument incorporating the tone signal generation device according to the present invention. In the electronic musical instrument of this embodiment, operations and processings are controlled by a microcomputer section including a CPU (central processing unit) 11, a program ROM (read-only memory) 12 and a data and working RAM (random-access memory) 13. A keyboard 14 includes keys for designating tone pitch of a tone to be generated.

On an operation panel section 15 are provided operators and selectors for controlling sampling of external or internal tone signals or controlling tones and also a microphone 16 for receiving a tone signal from outside.

An allocation selector 17 is an operator for performing selection or setting for allocating a sampled tone to any of a plurality of performance parts. The performance parts consist, for example, of three parts of "melody", "chord" and "bass". Classifying these parts on the basis of tone range into a part of a normal tone range and a part of bass tones, the "melody" and "chord" parts correspond to the part of the normal tone range and the part of "bass" corresponds to the part of bass tones. For example, the allocation selector 17 has four push switches **17*a*, 17*b*, 17*c* and 17*d* and these switches 17*a*–17*d*** correspond respectively to the "melody", "chord" and "bass" parts and "off". The "off" designates that the sampled tone should not be allocated to any performance part.

In storing waveform sampled data in a data memory 28 in a tone generator section 24, a record selector 18 selects either storing of a tone signal applied from outside (i.e., external tone sampling mode) or storing of a tone signal generated by an FM tone generator 25 which is a built-in tone source in this electronic musical instrument (i.e., internal tone sampling mode). In the record selector 18, an internal tone sampling switch FMSMPL is a switch for selecting that a tone signal generated by the FM tone generator 25 which is a built-in tone source should be stored in a data memory 28

(internal tone sampling mode) and an external tone sampling switch EXSMPL is a switch for selecting that a tone signal applied from outside should be stored in the data memory 28 (external tone sampling mode).

A sampled tone editing operator group 19 is a group of operators for performing editing of sampled tones recorded in the data memory 28. As an example of processings for editing sampled tones, there are an "overwrite" processing for overwriting waveform sampled data of one tone on waveform sampled data of another tone which has already been stored in the data memory 28 without deleting the waveform sampled data of the other tone, a processing for setting and controlling an envelope to be imparted to waveform sampled data to be read out from the memory 28 as desired, a "reverse" processing for making performance by reading out waveform sampled data of a sampled tone stored in the memory 28 in reverse direction, a "U-turn" processing for making performance by reading out waveform sampled data stored in the memory 28 in forward direction first and then in reverse direction, a "loop" processing for reading out waveform sampled data stored in the memory 28 repeatedly and various other processings. Specific examples of such processings for editing sampled tones are disclosed, for example, in the specification of Japanese Patent Application No. 1209/1987 and no detailed explanation of such processings will be made in this specification.

A tone color selector 20 is provided for selecting a tone color of a tone signal generated by the FM tone generator 25 which is the built-in tone source in the electronic musical instrument.

An automatic performance selector 21 includes automatic bass/chord performance (ABC) ON and OFF switches 21*a* and 21*b*, an automatic rhythm selector 21*c* and an automatic rhythm start/stop switch 21*d*. The ABC-ON switch 21*a* turns on an automatic bass/chord performance and the ABC-OFF switch 21*b* turns it off. The automatic rhythm selector 21*c* selects kind of automatic rhythm. The automatic rhythm start/stop switch 21*d* controls starting and stopping of the automatic rhythm.

An adjusting operator group 22 is provided for adjusting tone pitch or tone volume and includes a pitch switch PS, a volume switch VS, and increase switch INC, a decrease switch DEC, a transposition up switch UPS and a transposition down switch DWS. The pitch switch PS is a switch for finely adjusting tone pitch of a sampled tone read out from the data memory 28. The volume switch VS is a switch for adjusting an entire tone volume of a tone. The increase switch INC is a switch for increasing the amount of tone pitch adjustment or the amount of tone volume adjustment. The decrease switch DEC is a switch for decreasing the amount of tone pitch adjustment or the amount of tone volume adjustment. Turning on of the pitch switch PS brings about a mode in which the increase switch INC and the decrease switch DEC are used for adjusting tone pitch of the sampled tone. In this case, as an example, the tone pitch can be adjusted (i.e., tuned) at a unit of one cent within range of plus and minus 50 cents. On the other hand, turning of the volume switch VS brings about a mode in which the increase switch INC and the decrease switch DEC are used for adjusting an entire amount of tone volume of the tone.

As a special function, there is a "reference tone sounding tuning function". This function becomes effective when the increase switch INC or decrease switch DEC has been operated while the pitch switch PS is kept depressed. According to this function, a sampled tone (i.e., tone read out from the data memory 28) which has been adjusted in its pitch in accordance with the operation of the increase switch INC or the decrease switch DEC is sounded at a predetermined reference tone pitch (e.g., tone pitch of A4 tone) and, simultaneously, a tone of the same reference tone pitch (tone pitch of A4 tone) is sounded from the FM tone generator which is the built-in tone source at a normal pitch which has not been adjusted. The pitch adjusted sampled tone is compared with this reference tone of the normal pitch in hearing and the result of the comparison is utilized for the pitch adjusting operation of the sampled tone.

The transposition up switch UPS and transposition down switch DWS are switches for adjusting tone pitch of a tone at a unit of half tone within range of, e.g., plus and minus one octave. The tone pitch rises by operation of the up switch UPS and falls by operation of the down switch DWS. If the transposition up switch UPS or down switch DWS is operated alone, tone pitch adjustment, i.e., transposition, of the entire musical instrument is effected. In addition thereto, as a special function, a "sampled tone transposition function" by which tone pitch adjustment, i.e., transposition, can be effected with respect to only a sampled tone can be executed.

This "sampled tone transposition function" is effective when the up switch UPS or down switch DWS is operated while the pitch switch PS is kept depressed. The reason for effecting tone pitch adjustment, i.e., transposition, with respect to only a sampled tone is that tone pitch of a tone signal sampled from an external tone is not necessarily the reference tone pitch (e.g., tone pitch of A4 tone) and, accordingly, it is necessary to adjust the tone pitch of the external tone to the reference tone pitch.

In the operation panel section 15, there is also provided an operator group 23 including various operators for setting and controlling a tone.

The tone generator section 24 comprises the FM tone generator 25, a sampling tone generator 26 including the data memory 28 for storing digital waveform sampled data and a rhythm tone generator 27. When the external tone sampling mode has been selected by the external tone sampling switch EXSMPL of the record selector 18, this tone generator section 24 samples a tone signal applied from outside through the microphone 16 provided in the operation panel section 15 and converts it to digital waveform sampled data and writes it in the data memory 28. When the internal tone sampling mode has been selected by the internal tone sampling switch FMSMPL of the record selector 18, the tone generator section 24 generates a tone signal from the FM tone generator 25 provided as the built-in tone source and writes its digital waveform sampled data in the data memory 28. Further, in the performance mode, the tone generator section 24 generates a tone signal from the FM tone generator 25 in accordance with depression of a key in the keyboard 14 or the like operation and reads out waveform sampled data from the data memory 28 and generates a tone signal from the sampling tone generator 26 on the basis of the read out waveform sampled data. The tone generator section 24 also generates a rhythm tone signal from the rhythm tone generator 27 in accordance with a state of selection in the automatic performance selector 21. A tone signal generated by the tone generator section 24 is supplied to a sound system 29 and sounded therefrom.

The FM tone generator 25 provided as the built-in tone source synthesizes a tone signal by an FM (frequency modulation) system. On the other hand, the sampling tone generator 26 basically generates a tone signal by reading out waveform sampled data stored in the data memory 28.

In the tone generator section 24, a timer 30 is also provided. This timer 30 counts a predetermined period of time so that the mode is automatically changed to the internal tone sampling mode when no external tone signal has been applied during the external tone sampling mode for this predetermined period of time counted from starting of sampling.

A data ROM 31 stores various data for forming and controlling a tone. The data ROM 31 consists, for example, of a tone color parameter memory 31*a* storing tone color parameters (parameters for an FM tone synthesis operation) corresponding to tone colors which can be selected by the tone color selector 20, a rhythm pattern memory 31*b*, a chord pattern memory 31*c*, a bass pattern memory 31*d* and a sampled tone pattern memory 31*e*.

The rhythm pattern memory 31*b* stores data of a generation pattern of an automatic rhythm tone (percussion instrument tone) for each rhythm selectable by the rhythm selector 21*c*.

The chord pattern memory 31*c* stores data of a generation pattern of an automatic chord tone (accompanying chord tone) for each rhythm selectable by the rhythm selector 21*c*.

The bass pattern memory 31*d* stores data of a generation pattern of an automatic bass tone for each rhythm selectable by the rhythm selector 21*c*.

As a special function, there is an "extra percussion function" and the sampled tone pattern memory 31*e* is provided for performing this function. The "extra percussion function" is a function according to which tone pitch and tone sounding timing pattern of a tone (sampled tone) to be generated by the sampling tone generator 26 are designated and sounded in correspondence to the automatic rhythm. The sampled tone pattern memory 31*e* stores data of tone pitch and tone sounding timing pattern of a tone to be generated by the sampling tone generator 26 for each rhythm selectable by the rhythm selector 21*c*.

A tempo clock generator 32 generates a tempo clock pulse for the automatic rhythm performance. This tempo clock pulse functions as an interrupt signal to the microcomputer section. The microcomputer section counts the tempo clock pulse by an interrupt processing and thereby establishes a musical time pattern timing. In accordance with this musical time pattern data, i.e., tempo clock count data, respective pattern data are read out from the rhythm pattern memory 31*b*, chord pattern memory 31*c*, bass pattern memory 31*d* and sampled tone pattern memory 31*e*.

In this embodiment, the "extra percussion function" becomes effective when the ABC function is off by the operation of the ABC-OFF switch 21*b* notwithstanding that a sampled tone is allocated to the "bass" part by operation of the switch 17*c* of the allocation selector 17. But for this function, a sampled tone would not be sounded because the ABC function is off even if the sampled tone is allocated to the "bass" part. Owing to this "extra percussion function", however, a sampled tone can be automatically sounded in accordance with a selected rhythm.

Various processings including processings for key scanning for detecting a depressed or released key, key assigning, scanning and other processings for detecting an operated switch in the operation panel section 15 and writing and reading of sampled data in the tone generator section 24 are executed by the microcomputer section.

Figure 5:
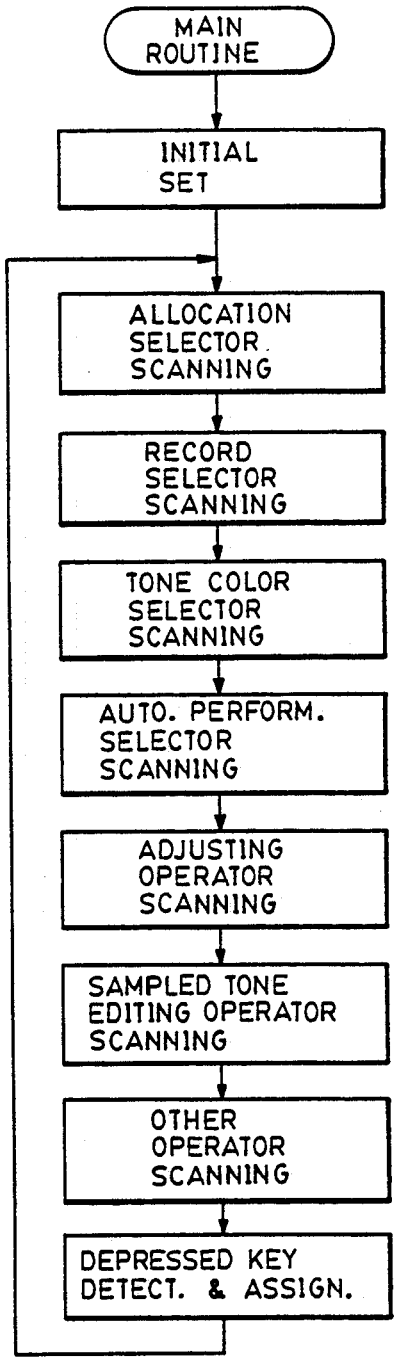

An example of a flow chart of processings relating to the present invention among the processing executed by the microcomputer section is shown in FIG. 5 and subsequent figures. An example of contents stored in the data and working RAM 13 used in connection with these processings is shown in FIG. 3.

Figure 3:
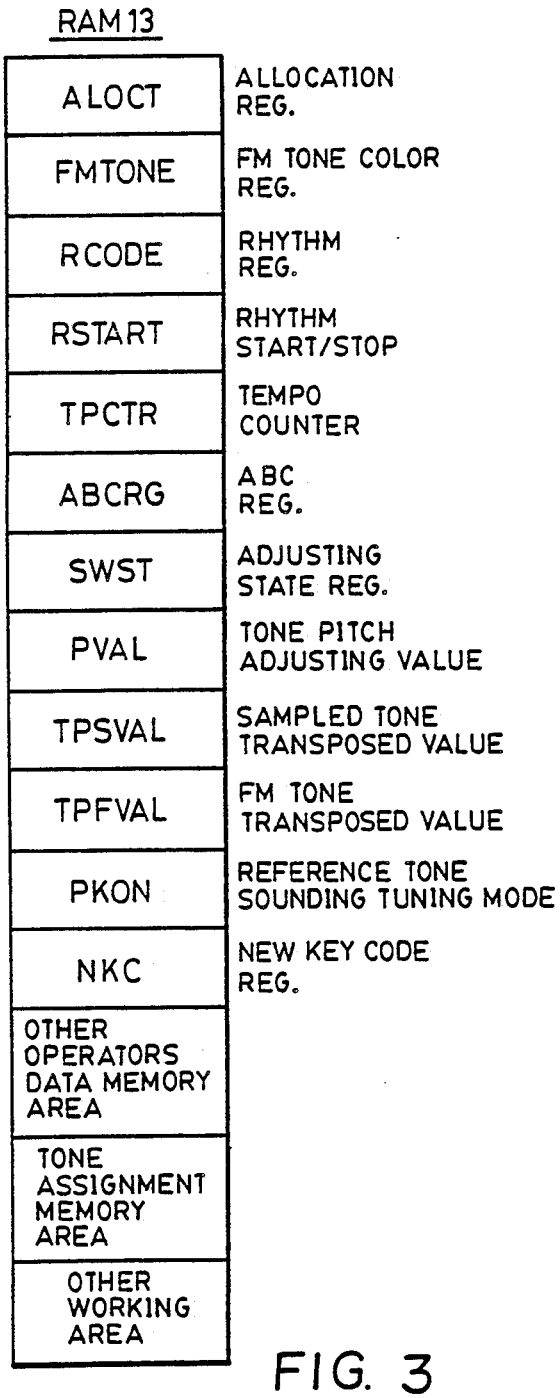
FIG. 3 is a diagram showing an example of the data and working memory in the microcomputer section of FIG. 2.

In FIG. 3, ALOCT denotes an allocation register which stores data representing a performance part to which a sampled tone should be allocated. "1" is stored for the "melody" part, "2" is stored for the "chord part", "3" is stored for the "bass" part and "0" is stored for "off".

FMTONE denotes an FM tone color register which stores data representing a tone color selected by the tone color selector 20.

RCODE denotes a rhythm register which stores data representing a rhythm selected by the rhythm selector 21*c*.

RSTART denotes a rhythm start/stop register which stores "1" when rhythm is on and "0" when rhythm is off.

TPCTR denotes a tempo counter which counts a temop clock pulse generated by a tempo clock generator 32 and registers the count value. The musical time pattern timing is established by this count value.

ABCRG denotes an ABC register which stores "1" when the automatic bass/chord performance is on and "0" when the automatic bass/chord performance is off.

SWST denotes an adjusting state register which stores "1" in a state where the increase switch INC and the decrease switch DEC are used for adjusting tone pitch of a sampled tone and stores "0" in a state where these switches INC and DEC are used for adjusting the entire tone volume.

PVAL denotes tone pitch adjusting value which represents tone pitch adjusting value of a sampled tone set by operation of the increase switch INC and decrease switch DEC. As described above, tone pitch adjustment (tuning) can be performed at a unit of, e.g., one cent within range of plus and minus 50 cents.

TPSVAL denotes sampled tone transposed value data which represents a transposed value of a sampled tone set by operation of the up switch UPS and the down switch DWS. As described above, tone pitch adjustment, i.e., transposition, can be performed at a unit of, e.g., half tone within range of plus and minus one octave.

TPFVAL denotes FM tone transposed value data which represents a transposed value of an FM tone (tone generated by the FM tone generator 25) set in accordance with operation of the up switch UPS and down switch DWS. As described above, tone pitch adjustment, i.e., transposition, can be performed at a unit of, e.g., half tone within range of plus and minus one octave.

PKON denotes a reference tone sounding tuning mode register which stores "1" when the above described "reference tone sounding tuning function" is on, i.e., when the increase switch INC or decrease switch DEC has been operated while the pitch switch PS is kept depressed, and otherwise stores "0".

NKC denotes a new key code register which stores a key code of a newly depressed key and a key code of a newly released key in the keyboard 14.

An area for the above described registers and data is provided in the data and working RAM 13. There are also provided other data and working areas in the data and working RAM 13 including an area of a key assignment memory storing state of key assignment to respective tone sounding channels in the FM tone generator 25 and the sampling tone generator 26 (TG in the figure represents a tone generator), and an area for storing detection data of operations of the sampled tone editing operator group 19 and the other operator group 23 in the operation panel section 15.

By way of an example, the number of tone generation channels in the FM tone generator 25 is "6" and the number of tone generation channels in the sampling tone generator 26 is "4".

Figure 4:
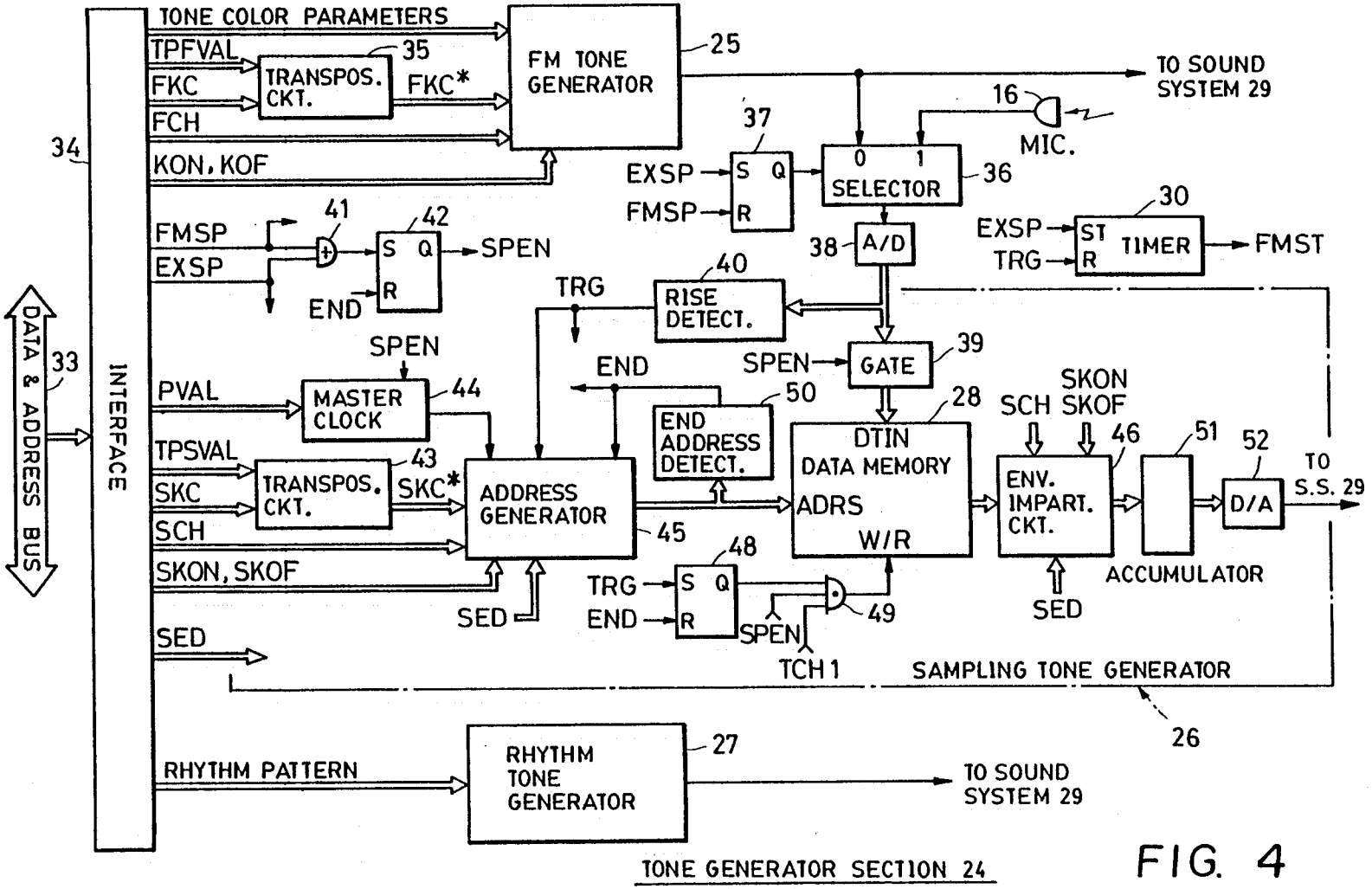
FIG. 4 is a block diagram showing a specific example of the tone generator of FIG. 2.

A specific example of the tone generator section 24 is shown in FIG. 4.

In the tone generator section 24 in FIG. 4, an interface 34 is provided for sending and receiving data with the microcomputer section side through a data and address bus 33. The interface 34 includes a buffer register. Data given by the microcomputer section is supplied to a predetermined circuit in the tone generator 20 section 24 through the interface 34. An FM sampling command signal FMST issued by the timer circuit 30 in the tone generator section 24 is given as an interrupt signal to the microcomputer section through the data bus 33.

Principal circuits in the tone generator section 24 will now e described briefly.

The FM tone generator 25 as the built-in tone source synthesizes a tone signal by the FM system. The FM tone generator 25 can generate tone signals of six tones simultaneously in six channels by the FM system. Tone color parameters of the tone generator 25 are supplied from the microcomputer section side. These tone color parameters are applied to the FM tone generator 25 through the interface 34 and the tone color of the tone to be synthesized in the FM tone generator 25 is determined in accordance with these tone color parameters. Upon determination by the microcomputer section of key assignment to any channel in the FM tone generator 25, a channel number FCH to which the sounding of the tone is to be assigned, a key code FKC representing the tone pitch of the tone to be assigned and a key-on signal KON are generated and the channel number FCH and the key-on signal KON are applied to the FM tone generator 25 through the interface 34 whereas the key code FKC is applied to the FM tone generator 25 further through a transposition circuit 35. The FM tone generator 25 stores the key code FKC and the key-on signal KON in correspondence to the tone generation channel designated by the channel number FCH and starts generation of a tone signal on the basis of these data. When sounding of a tone is to be finished, a channel number FCH indicating a channel in which sounding of the tone should be ceased and a key-off signal KOF are supplied from the microcomputer section through the interface 34. In accordance with these data, the FM tone generator 25 ceases storage of the key-on signal KON in the tone generation channel indicated by the channel number FCH and starts decaying of the tone signal in this particular tone generation channel.

The FM tone transposition value data TPFVAL is supplied from the microcomputer section to the transposition circuit 35 through the interface 34. The transposition circuit 35 increases or decreases the value of the key code FKC at a unit of half tone in accordance with the FM tone transposition value data TPFVAL. If, for example, the FM tone transposition data TPFVAL is +1 when the key code FKC designated A4 tone, the key code is provided after being converted to a key code of A#4 tone which is half tone higher. The converted key code FKC* is applied from the transposition circuit 35 to the FM tone generator 25.

The FM tone generator 25 adds digital tone signals generated in the respective channels together, converts the sum signal to an analog signal and thereafter outputs the analog tone signal. This analog tone signal is supplied to the sound system 29 and also to "0" input of the selector 36.

To the "1" input of the selector 36 is applied a tone signal from outside which has been picked up by the microphone 16 of the operation panel section 15. This selector 36 selects whether waveform sampled data which has been sampled from outside should be written in the data memory 28 of the sampling tone generator 26 or waveform sampled data of a tone signal generated by the FM tone generator 25 which is the built-in tone source should be written in the data memory 28.

When the waveform sampled data of a tone sampled from outside is written in the data memory 28 of the sampling tone generator 26, "1" is given as the external tone sampling signal EXSP from the microcomputer section through the interface 34. On the other hand, when waveform sampled data of a tone signal generated by the FM tone generator 25 is written, "1" is given as the internal tone sampling signal FMSP from the microcomputer section through the interface 34.

A flip-flop 37 receives the external tone sampling signal EXSP at its set input S and the internal tone sampling signal FMSP at its reset input R. An output Q of this flip-flop 37 is applied to a control input of the selector 36. When the external tone sampling signal EXSP is "1", the output Q of the flip-flop 37 becomes "1" so that the selector 36 selects an external tone signal from the microphone 16 applied to the "1" input of the selector 36. When the internal tone sampling signal FMSP is "1", the output Q of the flip-flop 37 becomes "0" so that the selector 36 selects an internal tone signal from the FM tone generator 25 applied to the "0" input of the selector 36.

The tone signal selected by the selector 36 is converted to a digital signal by an analog-to-digital converter 38. The digitally converted waveform sampled data is supplied to a data input terminal DTIN of the data memory in the sampling tone generator 26 through a gate 39. The waveform sampled data provided from the analog-to-digital converter 38 is also supplied to a rise detection circuit 40 in which rising of the tone is detected. In response to the detection of rising of the tone, a trigger pulse TRG is produced. This trigger pulse TRG is used as a signal indicating timing of starting writing of waveform sampled data in the data memory 28.

The above described external tone sampling signal EXSP and the internal tone sampling signal FMSP are applied to a set input S of a flip-flop 42 through an OR gate 41 and, when an external tone or a tone from the built-in tone source is sampled in the data memory 28, an output Q of the flip-flop 42 is set to "1". This output Q of the flip-flop 42 is supplied to the gate 39 as a sampling enable signal SPEN. The gate 39 is opened when this sampling enable signal SPEN is "1" to apply waveform sampled data of a sampled tone from the analog-to-digital converter 38 to the data input terminal DTIN of the data memory 28.

The sampling tone generator 26 generally comprises a transposition circuit 43, a master clock generator 44, an address generator 45, a data memory 28 consisting of a RAM and an envelope imparting circuit 46.

The address generator 45 generates a write address signal when a sampled tone is to be written in the data memory 28 and also a read address signal when a sampled tone is to be read out from this data memory 28. The address signal generated by the address generator 45 is supplied to an address input ADRS of the data memory 28.

The sampling tone generator 26 can generate four tones simultaneously in four channels. Accordingly, the address generator 45 can generate address signals for four channels on a time shared basis.

When a sampled tone is to be written in the data memory 28, the key code SKC of tone pitch corresponding to write rate is supplied to the sampling tone generator 26 from the microcomputer section side through the interface 34 and applied to the address generator 45 through the transposition circuit 43. The tone pitch corresponding to the write rate normally is a predetermined reference tone pitch (e.g., tone pitch of A4). Simultaneously, the channel number SCH indicating the channel 1 is supplied from the microcomputer section side to the sampling tone generator 26 through the interface 34 and applied to the address generator 45. The trigger pulse TRG produced in response to rising of the sampled tone is applied from the rise detection circuit 40 to the address generator 45. In response to application of this trigger pulse TRG, the address generator 45 starts generation, in the channel 1, of a write address signal which changes in accordance with the write rate of the above described reference tone pitch.

The trigger pulse TRG is supplied also to a set input of the flip-flop 48. An output signal of the flip-flop 48 set to "1" by the trigger pulse TRG is applied to one input of an AND gate 49. To other inputs of the AND gate 49 are applied the sampling enable signal SPEN from the flip-flop 42 and a timing signal THC1 which is in synchronism with the time division timing of the channel 1. The output signal of the AND gate 49 is supplied to a read and write control input W/R of the data memory 28 and the data memory 28 is brought into the write mode when the output signal of the AND gate 49 is "1" and into the read mode when this output signal is "0". Accordingly, during writing, the data memory 28 is brought into the write mode at the timing of the channel 1 at which the write address signal is generated so that waveform sampled data of the sampled tone applied to the data input terminal DTIN through the selector 36, analog-to-digital converter 38 and gate 39 is sequentially written at addresses of the data memory 28 designated by the write address signal.

The range of the write address is determined in accordance with a memory size for one sampled tone in the data memory 28 and the end address within this write address range is detected by an end address detection circuit 50. In other words, the write address signal generated by the address generator 45 is applied to the end address detection circuit 50 and, when the write address signal has reached the end address, a signal "1" is produced as an end detection signal END.

The end detection signal END is supplied to the address generator 45 whereupon generation of the write address is finished. The end detection signal END is also applied to reset inputs R of the flip-flops 42 and 48 thereby resetting the sampling enable signal SPEN to "0" and resetting the flip-flop 48 to finish the write mode.

Upon finishing of the write mode, the output of the AND gate 49 maintains "0" constantly thereby bringing the data memory 28 to the read mode.

The external tone sampling signal EXSP is supplied to a start trigger input ST of the timer 30 so that the counting operation of the timer 30 is started when the external tone sampling mode has been established, i.e., when the external tone sampling signal EXSP has risen from "0" to "1". To a reset input of the timer 30 is applied the trigger pulse TRG. The operation time of the timer 30 is, for example, in the order of ten seconds. If the trigger pulse TRG is provided during this operation time of the timer 30, the timer 30 is reset and no output is produced. On the other hand, if the operation time of ten seconds has elapsed without application of the trigger pulse TRG, the output of the timer 30 becomes "1" and this signal "1" is supplied to the microcomputer section as an interrupt command through the data bus 33. The microcomputer section is switched in its mode to the internal tone sampling mode upon receipt of the FM sampling command signal FMST. Thus, if there is no input of the external tone signal for a predetermined period of time from start of sampling of the external tone, the mode is automatically changed to the internal tone sampling mode. By this arrangement, in a case where the external tone signal has not been sampled despite designation of external tone sampling for some reason (such, for example, as an erroneous operation in sampling the external tone, disorder of the microphone or other device, failure in inputting the external tone and interruption in the external tone sampling operation), the mode is automatically changed to the internal tone sampling mode and the internal tone is sampled in the data memory 28. An untroubled use of the sampling tone generator 26 during performance thereby is ensured.

The generation of a tone signal from the sampling tone generator 26 is performed in accordance with the key assigning operation in the microcomputer section. Upon determination in the microcomputer section of a channel to which tone generation should be assigned, the channel number SCH indicating the channel to which tone generation should be assigned, key code SKC representing the tone pitch of the tone to be assigned and key-on signal SKON are produced and the channel number SCH and the key-on signal SKON are applied to the address generator 45 through the interface 34 and the key code SKC is applied to the address generator 45 further through the transposition circuit 43. The address generator 45 stores the key code SKC and the key-on signal SKON in correspondence to the tone generation channel designated by the channel number SCH and, in response thereto, generates a read address signal which changes at a rate corresponding to the tone pitch of the key code SKC at a time division timing corresponding to the channel designated by the channel number SCH.

The sampled tone transposition value data TPSVAL is supplied to the transposition circuit 43 through the interface 34. The transposition circuit 43 increases or decreases the value of the key code SKC at a unit of half tone in response to the sampled tone transposition value data TPSVAL. If, for example, the sampled tone transposition value data TPSVAL is +1 when the key code SKC designates A4 tone, the transposition circuit 43 converts the key code to one for A#4 tone which is half tone higher and delivers out this key code SKC*. The converted key code SKC* is applied from the transposition circuit 43 to the address generator 45.

The tone pitch adjusting value data PVAL is supplied to the master clock generator 44 from the microcomputer section through the interface 34. The master clock generator 44 controls the frequency of the master clock pulse in response to the tone pitch adjusting value PVAL. The frequency-controlled master clock pulse is supplied to the address generator 45 and the basic timing of the address signal generated by the address generator 45 is established in response to this master clock pulse. Accordingly, by controlling the frequency of the master clock pulse in response to the tone pitch adjusting value data PVAL, the changing rate of the address signal determined in response to the key code SKC* is subtly variably controlled whereby tone pitch adjustment at a unit of one cent can be achieved.

The sampling enable signal SPEN is applied to the master clock generator 44 so that controlling of the frequency of the master clock pulse is prohibited during sampling. This arrangement is made because writing of waveform sampled data in the data memory 28 should be made at a constant rate corresponding to the normal pitch of the reference tone pitch (A4 tone).

Various data SED for editing a sampled tone are supplied from the microcomputer section to the sampling tone generator 26 through the interface 34. These sampled tone editing data SED are applied to the address generator 45 and the envelope imparting circuit 46. In response to these sampled tone editing data SED, the address generator 45 can perform the read address control in accordance with the manner of sampled tone generation such as the above described "reverse", "U-turn" and "loop ". The envelope imparting circuit 46 can perform, in response to these sampled tone editing data SED, a special type of envelope control such as "echo".

The envelope imparting circuit 46 generates, in response to the channel number SCH and the key-on signal SKON provided through the interface 34, a tone volume controlling envelope signal corresponding to the channel designated by the channel number SCH thereby imparting waveform sampled data of the channel read out from the data memory 28 with the tone volume envelope. The waveform sampled data imparted with the tone volume envelope of all channels are added together in an accumulator 51 and thereafter the sum signal is converted to an analog signal by a digital-to-analog converter 52 and supplied to the sound system 29.

When the tone generation should be finished, the channel number SCH indicating the channel in which tone generation should be finished and the key-off signal SKOF are provided through the interface 34 and, in response to these signals, the envelope imparting cirucit 46 starts decaying of the tone volume controlling envelope signal in the channel designated by the channel number SCH.

To the rhythm tone generator 27 is applied a tone generation timing signal from the microcomputer section through the interface 34 at a timing of generation of each rhythm tone (percussion instrument tone). The rhythm tone generator 27 generates a tone signal of the rhythm tone (percussion instrument tone) for which the tone generation timing signal has been produced and supplies this tone signal to the sound system 29.

Referring now to the flow chart of FIG. 5 and subsequent figures, operations of this electronic musical instrument will be described.

In the main routine should in FIG. 5, contents of registers in the data and working RAM 13 are initially established.

In "allocation selector scanning processing", states of switches 17*a*–17*d* of the allocation selector 17 are scanned and a predetermined processing is executed in response to a switch which is on. In this routine, when turning of any of the switches 17*a*–17*d* from the off state to the on state has been detected, a switch-on event routine should in FIG. 6*a*–6*d* is executed in response to such switch.

Figure 7:
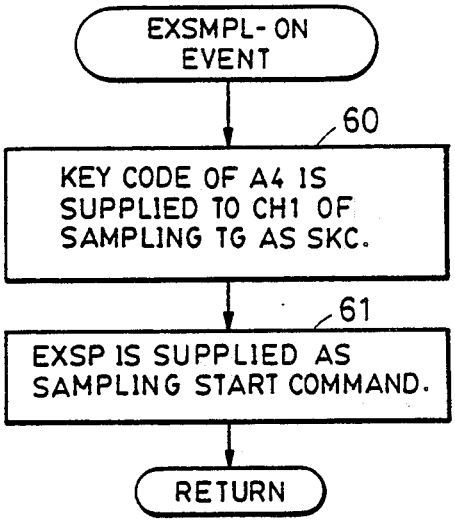
Figure 8:
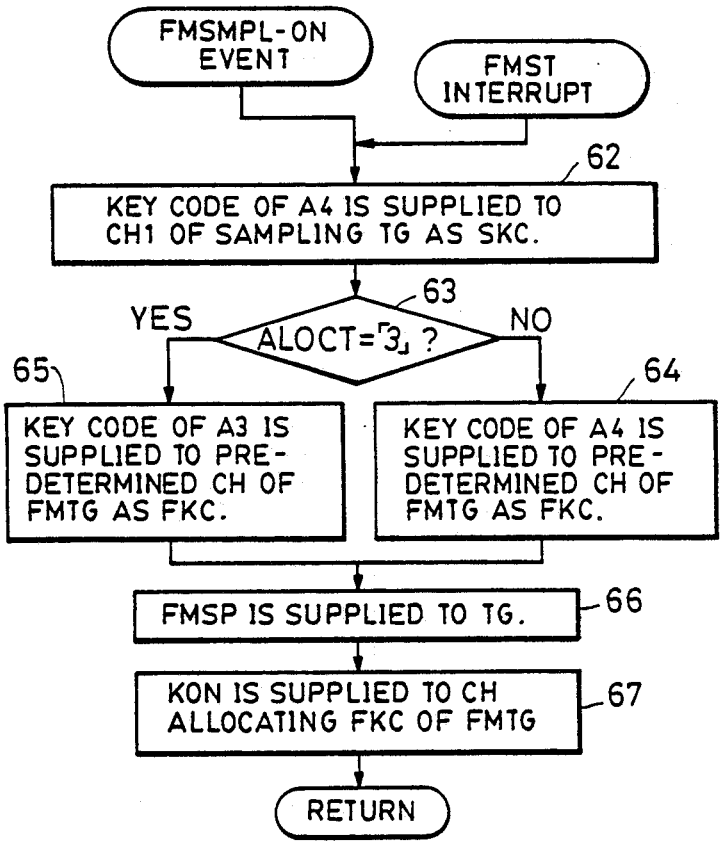

In "record selector scanning processing", states of switches of the record selector 18 are scanned and a predetermined processing is executed in response to a switch which is on. In this routine, when turning of the external tone sampling switch EXSMPL from the off state to the on state has been detected, an EXSMPL-on event routine shown in FIG. 7 is executed. When turning of the internal tone sampling switch FMSMPL from the off state to the on state has been detected, an FMSMPL-on event routine shown in FIG. 8 is executed. When the above described FM sampling command signal FMST has been given, a processing similar to the FMSMPL-on event routine of FIG. 8 is executed as an FMST interrupt routine.

Figure 9:
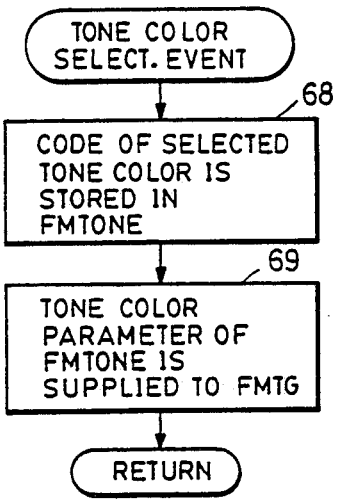

In "tone color selector scanning processing", the operation state of the tone color selector 20 is detected and a predetermined processing is executed in accordance with the tone color selection operation. In this routine, upon detection that an operation for selecting any tone color has been made, a tone color selction event routine shown in FIG. 9 is executed.

Figure 10A:
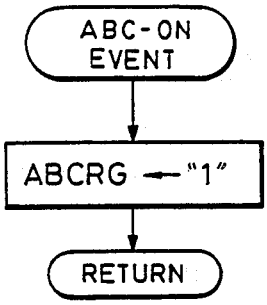
Figure 10B:
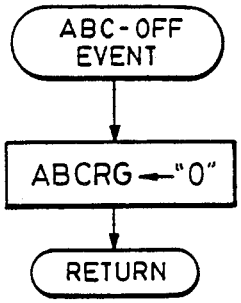
Figure 11:
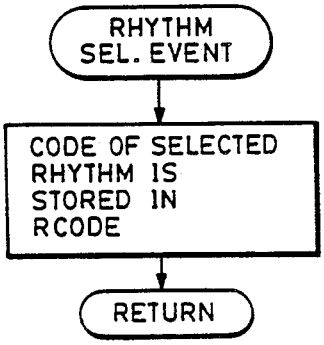
Figure 12:
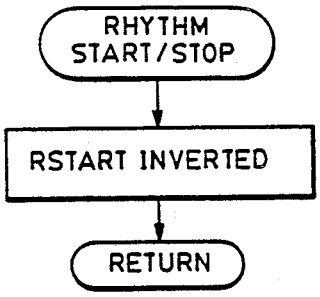

In "automatic performance selector scanning processing", the operation state of the automatic performance selector 21 is detected and a predetermined processing is performed in accordance with the detection. In this routine, when turning of the ABC-ON switch 21*a* from the off state to the on state has been detected, an ABC-ON event routine shown in FIG. 10*a* is executed. When turning of the ABC-OFF switch 21*b* from the off state to the on state has been detected, an ABC-OFF event routine shown in FIG. 10*b* is executed. Further, when it has been detected that an operation for selecting some rhythm has been made by the automatic rhythm selector 21*c*, a rhythm selection event shown in FIG. 11 is executed. Further, when turning of the automatic rhythm start/stop switch 21*d* from the off state to the on state has been detected, a rhythm start/stop event routine shown in FIG. 12 is executed.

Figure 13:
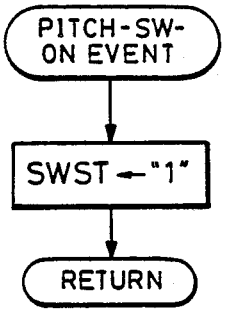
Figure 15:
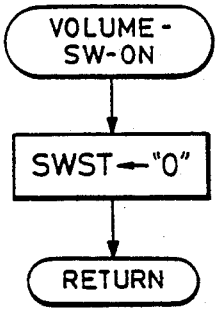
Figure 14:
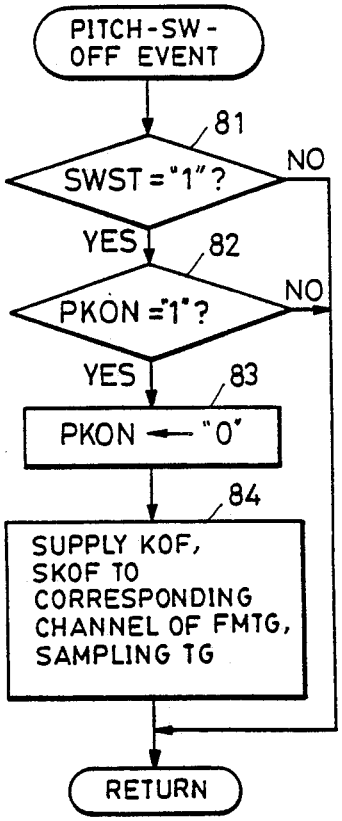
Figure 16:
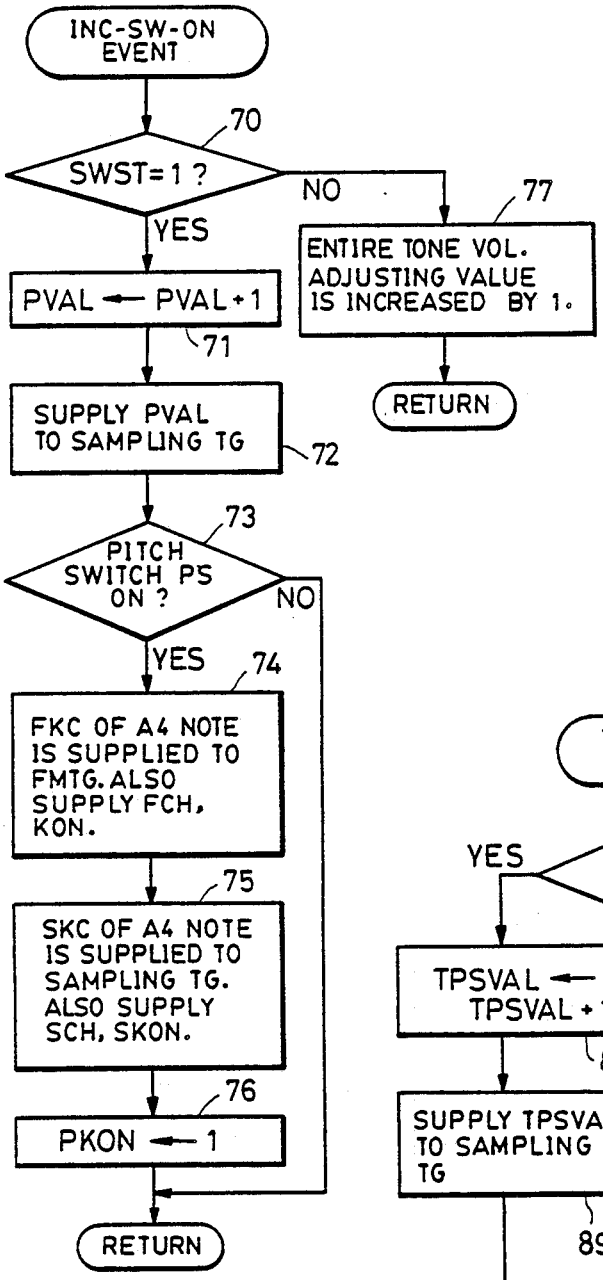
Figure 17:
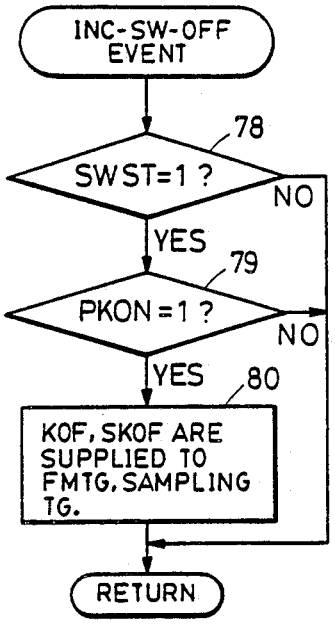
Figure 18:
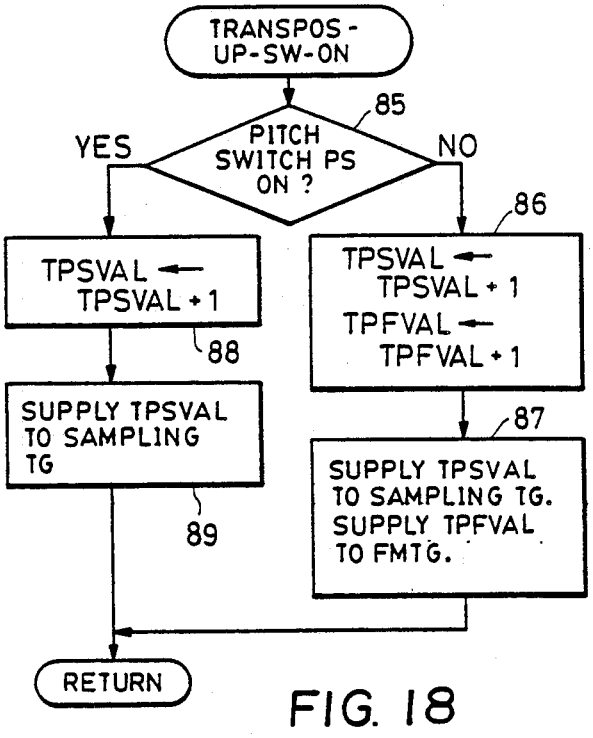

In "adjusting operator scanning processing", the operation state of the adjusting operator group 22 is detected and a predetermined processing is executed in accordance with the detection. In this routine, when turning of the pitch switch PS from the off state to the on state has been detected, a pitch-switch-on event routine shown in FIG. 13 is executed. Conversely, when turning of the pitch switch PS from the on state to the off state has been detected, a pitch-switch-off event routine shown in FIG. 14 is executed. When turning of the volume switch VS from the off state to the on state has been detected, a volume-switch-on event routine shown in FIG. 15 is executed. When turning of the increase switch INC from the off state to the on state has been detected, an increase-switch-on event routine shown in FIG. 16 is executed. Conversely, when turning of the increase switch INC from the on state to the off state has been detected, an increase-switch-off event routine shown in FIG. 17 is executed. When turning of the decrease switch DEC from the off state to the on state has been detected, a decrease-switch-on event routine (not shown) which is similar to the routine of FIG. 16 is executed. When turning of the decrease switch DEC from the on state to the off state has been detected, a decrease-switch-off event routine (not shown) which is similar to the routine of FIG. 17 is executed. When turning of the transposition down switch DWS from the off state to the on state has been detected, a transposition-down-switch-on event routine (not shown) which is similar to the routine of FIG. 18 is executed.

In "sampled tone editing operator scanning processing", the operation state of each operator of the sampled tone editing operator group 219 is detected and a predetermined processing is executed in accordance with the detection. In accordance with this processing, the above described sampled tone editing data SED is generated and supplied to the tone generator section 24.

In "other operator scanning processing", the operation state of each operator of the other operator group 23 for setting and controlling a tone is detected and a predetermined processing is executed in accordance with contents of the operation detected.

In "depressed key detection and key assigning processing", a processing for assigning generation of a tone corresponding to a depressed key to a proper tone generation channel and a processing based on release of a depressed key are executed. In this routine, when a new depressed key has been detected, a new-key-on event routine shown in FIG. 19 is executed and, when a new released key has been detected, a new-key-off event routine shown in FIG. 20 is executed.

If a tempo clock signal is provided by the tempo clock generator 32 during execution of the main routine, a tempo clock interrupt routine shown in FIG. 21 is executed.

Allocation of sampled tones

The performer can allocate a sampled tone to a desired performance part by operation of the allocation selector 17.

Figure 6A:
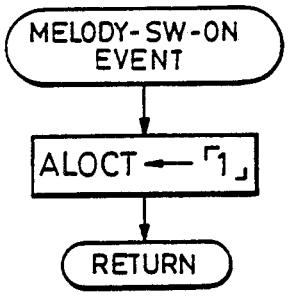

If a sampled tone is to be allocated to the "melody" part, the switch 17*a* of the allocation selector 17 is turned on. Thereupon, a melody-switch-on event routine shown in FIG. 6*a* is executed and data "1" indicating that the sampled tone has been allocated to the "melody" part is stored in the allocation register ALOCT.

Figure 6B:
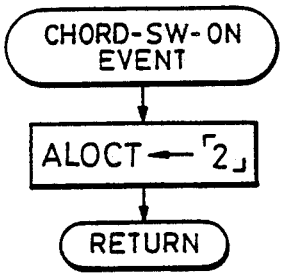

If the sampled tone is to be allocated to the "chord part", the switch 17*b* of the allocation selector 17 is turned on. Thereupon, a chord-switch-on event routine shown in FIG. 6*b* is executed and data "2" indicating that the sampled tone has been allocated to the "chord" part is stored in the ALOCT.

Figure 6C:
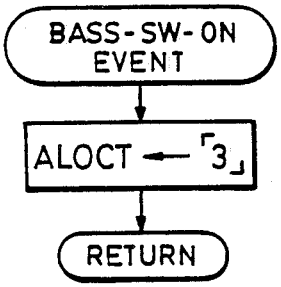

If the sampled tone is to be allocated to the "bass" part, the switch 17*c* of the allocation selector 17 is turned on. Thereupon, a bass-switch-on event routine shown in FIG. 6*c* is executed and data "3" indicating that the sampled tone has been allocated to the "bass" part is stored in the allocation register ALOCT.

Figure 6D:
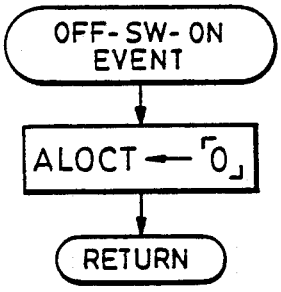

If the sampled tone is not to be allocated to any part, the switch 17*d* of the allocation selector 17 is turned on. Thereupon, an off-switch-on event routine shown in FIG. 6*d* is executed and data "0" indicating that the sampled tone is not allocated to any part is stored in the allocation register ALOCT.

Sampling of an external tone

If a tone signal applied from outside is to be sampled in the data memory 28 of the tone generator section 24, the external tone sampling switch EXSMPL of the record selector 18 is turned on. Thereupon, an EXSMPL-on event routine shown in FIG. 7 is executed. In this routine, to the sampling tone generator are supplied a predetermined reference tone pitch (e.g., tone pitch of A4 tone) as the key code SKC and data indicating the channel 1 as the channel number SCH (step 60). Then, the external tone sampling signal EXSP is supplied to the tone generator section 24 as the sampling start command (step 61).

By the above described routine, the tone generator section 24 of FIG. 4 is brought into a state in which it can select an external tone signal from the microphone 16 by the selector 36. The sampling enable signal SPEN is turned to "1" to open the gate 39 thereby enabling the external tone selected by the selector 36 to be applied to the data input terminal DTIN of the data memory 28. The address generator 45 is set to a state in which it can generate a write address signal of a rate corresponding to the predetermined reference tone pitch (tone pitch of A4 tone) in the channel 1. The timer 30 is started in response to the external tone sampling signal EXSP.

If, in this state, the external tone signal is applied from the microphone 16 before the operation time of the timer 30 elapses, the trigger pulse TRG is generated from the rise detection circuit 40 in response to rising of the external tone signal. In response to this trigger pulse TRG, the address generator 45 starts generation of the write address signal at a rate corresponding to the reference tone pitch (A4) in the channel 1. The data memory 28 is set to the write mode at a time division timing of the channel 1 and enables waveform sampled data of the external tone signal applied to the data input terminal DTIN through the gate 39 to be written at an address designated by the write address signal. On the other hand, the timer 30 is reset before elapse of the operation time in response to the trigger pulse TRG.

Sampling from the built-in tone source

If a tone signal generated by the FM tone generator 25 which is the built-in tone source is to be sampled in the data memory 28 of the tone generator section 24, the internal tone sampling switch FMSMPL is turned on. Thereupon, an FMSMPL-on event routine shown in FIG. 8 is executed. In this routine, to the sampling tone generator 26 is applied the key code of the predetermined reference tone pitch (A4 tone) as the key code SKC and also data indicating the channel 1 as the channel number SCH (step 62).

Next, whether or not contents of the allocation register ALOCT are "3" which indicates the "bass" part (step 63) is examined.

When the sampled tone is not allocated to the "bass" part, i.e., it is not allocated to the part of normal tone range of the "melody" or "chord", the routine proceeds to step 64 in which the key code of the predetermined reference tone pitch (A4 tone) is supplied as the key code FKC to the FM tone generator 25 and data indicating any desired channel is supplied as the channel number FCH.

When the sampled tone is allocated to "bass" part, the routine proceeds to step 65 in which a key code which is one octave lower than the predetermined reference tone pitch is supplied as the key code FKC to the FM tone generator 25 and data indicating any channel is supplied as the channel number FCH.

Then, the internal tone sampling signal FMSP is supplied as the sampling start command to the tone generator section 24 (step 66). Then, a key-on signal KON is supplied in correspondence to the channel number FCH.

By the arrangement described above, when the sampled tone is allocated to the part of normal tone range of the "melody" or "chord" part, the FM tone generator 25 of FIG. 4 generates a tone signal of the predetermined tone pitch (A4 tone). When the sampled tone is allocated to the "bass" part, the FM tone generator 25 of FIG. 4 generates a tone signal of a tone pitch which is lower by one octave than the predetermined reference tone pitch (i.e., A3 tone). In response to "1" of the internal tone sampling signal FMSP, the selector 36 selects a tone signal generated by the FM tone generator 25. The gate 39 is opened and a tone signal from the FM tone generator 25 which has been selected by the selector 36 is applied to the data input terminal DTIN of the data memory 28. The address generator 45 generates a write address of a rate corresponding to the predetermined reference tone pitch (tone pitch of A4 tone) in the channel 1. In this manner, the tone signal generated by the FM tone generator 25 is written in the data memory 28.

Thus, the tone pitch of a tone signal from the built-in tone source sampled in the data memory 28 is one octave lower when the tone signal is allocated to the "bass" part than when the tone signal is allocated to the part of the normal tone range. Accordingly, in reading the waveform sampled data, the tone pitch of the waveform sampled data read out from the data memory 28 at the same reading rate is lower by one octave in the case of a tone signal corresponding to waveform sampled data allocated to the bass tone part than in the case of a tone signal corresponding to waveform sampled data allocated to the part of the normal tone range. If, for example, waveform sampled data is read out at the tone pitch rate of A4 tone, a tone signal corresponding to waveform sampled data allocated to the part of the normal tone range is of the same tone pitch of A4 tone whereas a tone signal corresponding to waveform sampled data allocated to the bass tone part is of the tone pitch of A3 tone which is lower by one cotave. Accordingly, if, for example, the lowest tone pitch which can be designated by the keyboard 14 is C3 tone, a tone signal corresponding to waveform sampled data allocated to the bass tone part by the tone pitch designation of C3 tone is generated at the tone pitch of C2 tone so that, even if the construction of the keyboard 14 and the address generator 45 is of a relatively simple one corresponding to a relatively narrow tone range, an internal sampled tone allocated to the bass tone part can be generated in a sufficiently low tone range in reading and performance of the tone.

Automatic sampling from the built-in tone source

If the operation time of the timer 30 has elapsed without input of an external tone signal from the microphone 16 during the external tone sampling period or without detection of rising of an external tone signal by the rise detection circuit 40, no trigger pulse TRG is produced by the rise detection circuit 40 so that the timer 30 generates the FM sampling command signal FMST at the end of the operation time of the timer 30. In response to this signal FMST, a processing similar tot he FMSMPL-on event routine shown in FIG. 8 is executed as an FMST interrupt routine. Accordingly, by executing a processing similar to the one described above, a tone signal generated by the FM tone generator 25 is written in the data memory 28. Thus, when no external tone signal has been applied for a predetermined period of time from start of sampling of an external tone, the mode is changed automatically to the internal tone sampling mode. By this arrangement, if an external tone signal is not sampled despite designation of the external tone sampling for some reason such as erroneous operation in sampling the external tone, disorder of the microphone or other device, failure in inputting of an external tone or interruption of external tone sampling operation, the mode is automatically changed to the internal tone sampling mode and a tone signal generated by the FM tone generator 25 is sampled in the data memory 28.

Selection of an FM tone color

Tone color of a tone signal generated by the FM tone generator 25 is selected by the tone color selector 20. By this operation, a tone color selection event routine shown in FIG. 9 is executed. In this routine, a code signal representing the selected tone colors is registered in an FM tone color register FMTONE (step 68). Then, a tone color parameter corresponding to the tone code registered in the FM tone color register FMTONE is read out from a tone color parameter memory **31*a* in the data ROM 31 and the read out parameter is supplied to the FM tone generator 25 (step 69). The tone color of a tone signal generated by the FM tone generator 25 thereby is set to a tone color selected by the tone color selector 20**.

Selection of ABC

When the automatic bass/chord performance is to be made, the ABC-ON switch **21*a* is turned on. When the ABC-ON switch 21*a* has been turned from the off state to the on state, an ABC-ON event routine shown in FIG. 10*a*** is executed. In this routine, contents of an ABC register ABCRG are set to "1".

When the automatic bass/chord performance is not made, the ABC-OFF switch **21*b* is turned on. When the ABC-OFF switch 21*b* has been turned from the off state to the on state, an ABC-OFF event routine shown in FIG. 10*b*** is executed. In this routine, contents of the ABC register ABCRG are reset to "0".

Selection and start/stop of the automatic rhythm

When an operation for selecting a desired rhythm by the automatic rhythm selector **21*c* is made, a rhythm selection event routine shown in FIG. 11** is executed. In this routine, a code signal representing a selected rhythm is registered in a rhythm register RCODE.

When the automatic rhythm performance is to be started or stopped, the automatic rhythm start/stop switch **21*d* is turned on. A rhythm start/stop event routine shown in FIG. 12 thereby is executed. In this routine, contents of a rhythm start/stop register RSTART are inverted. When the contents of the rhythm start/stop register RSTART are "1", staring of the automatic rhythm performance is designated and, when the contents are "0", stopping of the automatic rhythm performance is designated. Accordingly, each time the automatic rhythm start/stop switch 21*d*** is turned on, start and stop of the automatic rhythm performance is switched.

Adjustmenmt of tone pitch of a sampled tone

In a case where the increase switch INC and the decrease switch DEC are used for adjusting of tone pitch of a sampled tone, the pitch switch PS is first turned on. Thereupon, a pitch-switch-on event routine shown in FIG. 13 is executed. In this routine, contents of an adjusting state register SWST are set to "1". Setting of the contents of the adjusting state register SWST to "1" represents that the increase switch INC and the decrease switch DEC are usable for adjusting the tone pitch of a sampled tone.

Conversely, the increase switch INC and the decrease switch DEC are used for adjusting of the entire tone volume, the volume switch VS is turned on. In this case, a volume-switch-on event routine shown in FIG. 15 is executed. In this routine, contents of the adjusting state register SWST are reset to "0" which represents that the increase switch INC and the decrease switch DEC can be used for adjusting of the entire volume.

Upon turning on of the increase switch INC, an increase-switch-on event routine shown in FIG. 16 is executed. In this routine, whether or not contents of the adjusting state register SWST are "1" is examined (step 70). If the contents are "1", i.e., a state in which adjusting of tone pitch of a sampled tone can be made, the routine proceeds to step 71 in which the tone pitch adjusting value PVAL is increased by 1. Then, this tone pitch adjusting value is supplied to the sampling tone generator 26 (step 72). Then, whether or not the pitch switch PS is kept in the on state is examined (step 73). If the pitch switch PS is not kept in the on state, the routine returns. In this manner, in response to one ON operation of the increase switch INC, the tone pitch adjusting value PVAL is increased by 1.

When the decrease switch DEC has been turned on, a decrease-switch-on event routine (not shown) is executed. In this decrease-switch-on event routine, a processing which is substantially the same as the increase-switch-on event routine of FIG. 16 is executed except that the tone pitch adjusting value PVAL is decreased by 1 in the decrease-switch-on event routine. Thus, in response to one ON operation of the decrease switch DEC, the tone pitch adjusting value PVAL is decreased by 1.

In the foregoing manner, the tone pitch adjusting value data PVAL which has been set to a desired value is applied to the master clock generator 44 of the sampling tone generator 26 of FIG. 4 whereby tone pitch of a tone signal generated by the sampling tone generator 26 is finely adjusted at a unit of one cent as described above.

In the case where the entire tone volume is to be adjusted, the contents of the adjusted state register SWST are "0" so that step 70 of FIG. 16 is NO and the routine proceeds to step 77 in which the entire tone volume adjusting value is increased by 1.

Reference tone sounding tuning function

For executing "reference tone sounding tuning function" according to which a sampled tone under tone pitch adjustment is sounded by the sampling tone generator 26 and a reference tone is sounded by the FM tone generator 25 whereby the reference tone and the pitch adjusted sampled tone are compared with each other in hearing, the increase switch INC or the decrease switch DEC is operated while the pitch switch PS is kept pushed.

In this case, if, for example, the increase switch INC is turned on while the pitch switch PS is kept pushed, step 73 of FIG. 16 becomes YES and the processing proceeds to step 74. In this step, a key code of a predetermined reference tone pitch (A4 tone) is supplied as the key code FKC to the FM tone generator 25, data indicating a desired channel is supplied as the channel number FCH and the key-on singal KON is simultaneously supplied in correspondence to this channel.

Next, the key code of the predetermined reference tone pitch (A4 tone) is supplied as the key code SKC to the sampling tone generator 26, data indicating a desired channel is supplied as the channel number SCH and the key-on signal SKON is simultaneously supplied in correspondence to this channel (step 75).

Then, contents of a reference tone sounding tuning mode register PKON are set to "1" (step 76) which represents that the mode is the reference tone sounding tuning mode.

By this arrangement, the FM tone generator 25 of FIG. 4 generates a tone signal of the predetermined reference tone pitch (A4 tone) and this tone is sounded through the sound system 29. Simultaneously, the sampling tone generator 26 of FIG. 4 generates also a tone signal of a sampled tone at the predetermined reference tone pitch (A4 tone) and this tone is sounded through the sound system 29. However, the tone pitch of the tone signal generated by the sampling tone generator 26 is one which has been adjusted in its pitch (i.e., tuned) in accordance with the tone pitch adjusting data PVAL. Thus, the sampled tone under tone pitch adjusting and the reference tone of the normal tone pitch can be compared with each other in hearing.

When the decrease switch DEC is turned on while the pitch switch PS is kept pushed, a processing similar to steps 74–76 of FIG. 16 are executed by a decrease-switch-on event routine (not shown).

The sampled tone under tone pitch adjusting and the reference tone of the normal tone pitch are sounded only when the increase switch INC or the decrease switch DEC is on.

When the increase switch INC which was on has been turned off, an increase-switch-off event routine shown in FIG. 17 is executed. In this routine, whether or not contents of the adjusted state register SWST and the reference tone sounding tuning mode register PKON are respectively "1" is examined (steps 78 and 79). If these contents are "1", the key-off signal KOF is supplied to the FM tone generator 25 in correspondence to the channel in which a tone is being sounded and also the key-off signal SKOF is supplied to the sampling tone generator 26 in correspondence to the channel in which a tone is being sounded (step 80). By this step, sounding of the reference tone which is being sounded in the FM tone generator 25 and the sampled tone which is being sounded in the sampling tone generator 26 is finished.

When the decrease switch DEC which was on has been turned off, a processing similar to steps 78–80 of FIG. 17 is executed by a decrease-switch-off event routine (not shown).

Sounding of the reference tone and the sampled tone which are being sounded is finished also when the pitch switch PS has been turned off. When the pitch switch PS has been turned from the on state to the off state, a pitch-switch-off event routine shown in FIG. 14 is executed. In this routine, whether or not contents of the adjusted state register SWST and the reference tone tuning mode register PKON are respectively "1" is examined (steps 81 and 82). If the contents are "1", the contents of the reference tone sounding tuning mode register PKON are reset to "0" (step 83), the key-off signal KOF is supplied to the FM tone generator 25 in correspondence to the channel in which a tone is being sounded and the key-off signal SKOF is supplied to the sampling tone generator 26 in correspondence to the channel in which a tone is being sounded (step 84). By this step, sounding of the reference tone which is being sounded in the FM tone generator 25 and the sampled tone under tone pitch adjusting which is being sounded in the sampling tone generator 26 is finished.

Transposition of the entire musical instrument

In a case where a tone pitch adjustment by half tone, i.e., transposition, is to be performed, the transposition up switch UPS or the transposition down switch DWS alone is operated. If, for example, the transposition up switch UPS is turned on, a transposition-up-switch-on event routine shown in FIG. 18 is executed. In this routine, whether or not the pitch switch PS is simultaneously on is examined (step 85). If the pitch switch PS is not on, the routine proceeds to step 86 in which the sampled value transposition data value TPSVAL and the FM tone transposition value data TPFVAL are respectively increased by 1. Then, the sampled tone transposition value data TPSVAL is supplied to the sampling tone generator 26 and the FM transposition value data TPFVAL is supplied (step 87).

If the transposition down switch DWS alone has been turned on, a transposition-down-switch-on event routine (not shown) is executed. In this routine, a processing which is substantially the same as the transposition-up-switch-on event routine of FIG. 18 is executed except that the sampled tone transposition value data TPSVAL or the FM tone transposition value data TPFVAL is decreased by 1 in the transposition-down-switch-on event routine.

Thus, in response to one ON operation of the transposition up switch UPS only, the sampled tone transposition value data TPFVAL and the FM tone transposition value data TPFVAL are increased by 1 whereas in response to one ON operation of the transposition down switch DWS only, the sampled tone transposition value data TPSVAL and the FM tone transposition value data TPFVAL are decreased by 1.

The sampled tone transposition value data TPFVAL and the FM tone transposition value data TPFVAL are applied to the transposition circuit 43 of the sampling tone generator 26 and the transposition circuit 35 of the FM tone generator 25 of FIG. 4 whereby the tone pitch of the tone signals generated by the tone generators 25 and 26 is adjusted by half tone.

Sampled tone transposing function

In a case where a tone pitch adjustment by half tone, i.e., transposition, is to be performed with respect to the sampling tone generator 26 only, the up switch UPS or the down switch DWS is operated while the pitch swith PS is pushed. If, for example, the transposition up switch UPS is turned on while the pitch switch PS is pushed, a transposition-up-switch-on event routine shown in FIG. 18 is executed. In step 85, whether or not the pitch switch PS is simultaneously on is examined and, if the pitch switch PS is on, the routine proceeds to step 88 in which the sampled tone transposition value data TPSVAL only is increased by 1. Then, the sampled tone transposition value data TPSVAL is supplied tot he sampling tone generator 26 (step 89).

If the up switch UPS or the down switch DWS is turned on while the pitch switch PS is pushed, a transposition-down-switch-on event routine (not shown) is executed. In this routine, a processing which is substantially the same as steps 88–89 of FIG. 18 is executed by which the sampled tone transposition value data TPSVAL is decreased by 1.

The sampled tone transposition value data TPSVAL set to a desired value in the foregoing manner is applied to the transposition circuit 43 of the sampling tone generator 26 of FIG. 4 and, as described above, the tone pitch of the tone signal generated by the sampling tone generator 26 is adjusted by half tone.

The reason for enabling the tone pitch adjustment, i.e., transposition, to be made only to the sampled tone by such "sampled tone transposition function" is that the tone pitch of a tone signal of a tone sampled from outside is not necessarily the same as the reference tone pitch (A4 tone) of a write rate and, accordingly, it is necessary to adjust the tone pitch of the sampled tone to the reference tone pitch during reading.

During performance of the keyboard

The keyboard 14 is divided in two key ranges (i.e., upper key range and lower key range) during performance of the keyboard 14 in accordance with the selection state of the automatic bass/chord performance and the allocation state of a sampled tone to a performance part and the FM tone generator 25 and the sampled tone generator 26 are divided by the performance part in use. An example of such division is shown in Table 1 below. In this table, the vertical axis represents the selection state of the automatic bass/chord performance (ABC) while the horizontal axis represents contents of the allocation register ALOCT, i.e., the allocation state of each sampled tone to a performance part. The FM tone generator 25 is abbreviated as FM.TG and the sampling tone generator 26 as SM.TG. The channel number used, i.e., the number of tones which can be sounded simultaneously, is abbreviated as 6CH, 4CH, 3CH, 1CH etc. As an example of manner of expression in the table, the case where ABC is ON and the sampled tone is allocated to the melody part is described as "UK: SM.TG (4CH)""LK: chord; FM.TG(3CH) bass; FM.TG(1CH)". This represents that sounding of a depressed key in the upper key range UK is allocated to any of four channels of the sampling tone generator 26, a chord tone and a bass tone are sounded in response to a depressed key in the lower key range LK and sounding of a chord tone is assigned to any of three channels of the FM tone generator 25 whereas sounding of a bass tone is assigned to one channel of the FM tone generator 25.

For another example, the case that ABC is OFF and the sampled tone is allocated to the bass part is described as "all keys: FM.TG (6CH)(extra percussion with SM.TG)". This represents that sounding of a depressed key in the entire key range in the keyboard 14 is assigned to any of six channels of the FM tone generator 25 and that the sampling tone generator 26 is used for "extra percussion function".

TABLE 1

| State | Allocation of a sampled tone | | | |
|---|---|---|---|---|
| of ABC | off | melody | chord | bass |
| OFF | all keys: FM.TG (6CXH) | UK: SM.TG (4CH) LK: | UK: FM.TG (6CH) LK: | all keys: FM.TG (6CH) (extra |

TABLE 1-continued

| State of ABC | Allocation of a sampled tone | | | |
|---|---|---|---|---|
| | off | melody | chord | bass |
| ON | | FM.TG (6CH) | SM.TG (4CH) | percussion with SM.TG) |
| | UK: FM.TG (2CH) LK: chord; FM.TG (3CH) bass; FM.TG (1CH) | UK: SM.TG (4CH) LK: chord; FM.TG (3CH) bass; FM.TG (1CH) | UK: FM.TG (5CH) LK: chord; SM.TG (3CH) bass; FM.TG (1CH) | UK: FM.TG (3CH) LK: chord; FM.TG (3CH) bass; SM.TG (1CH) |

Figure 19A:
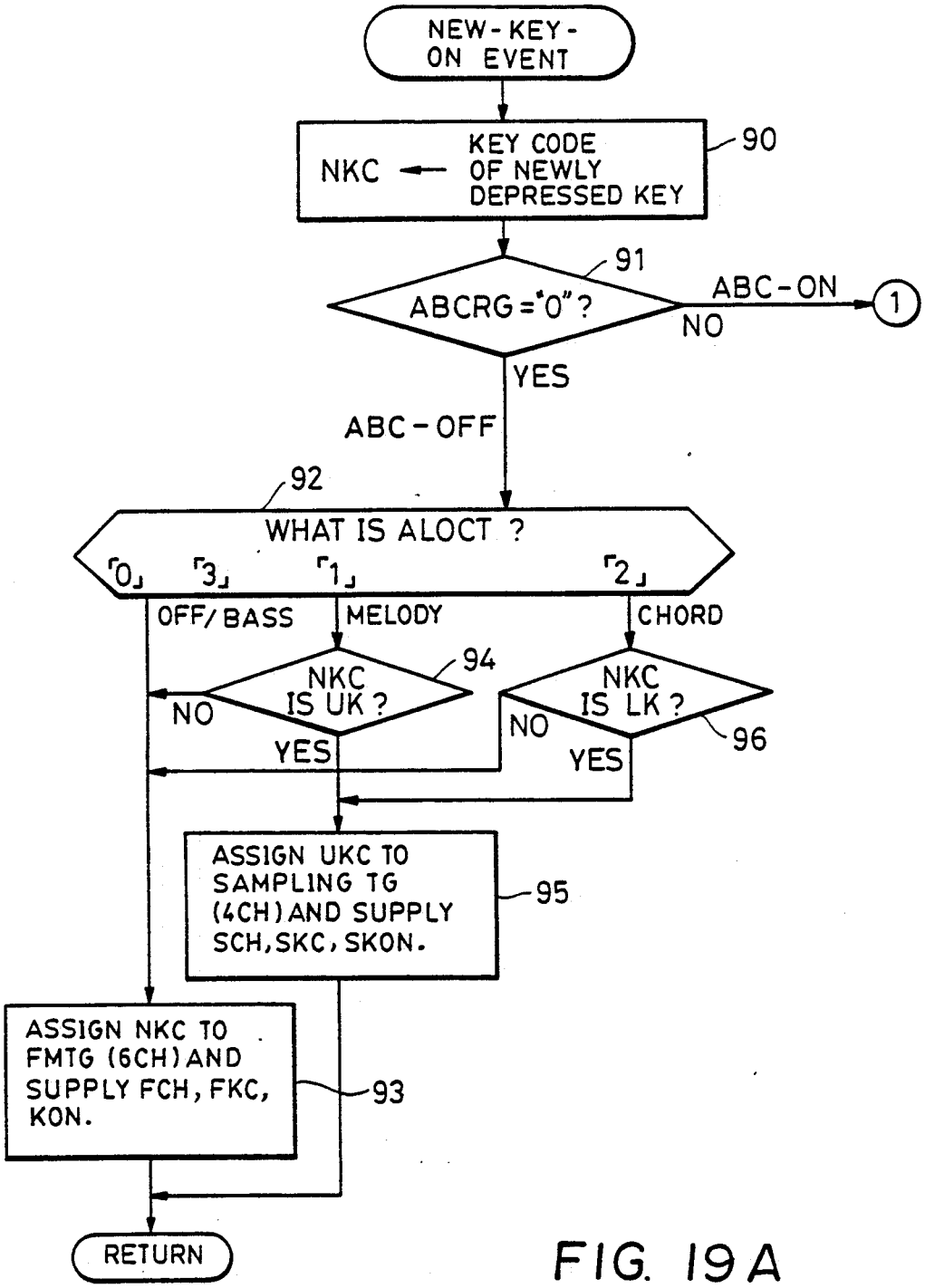
Figure 19B:
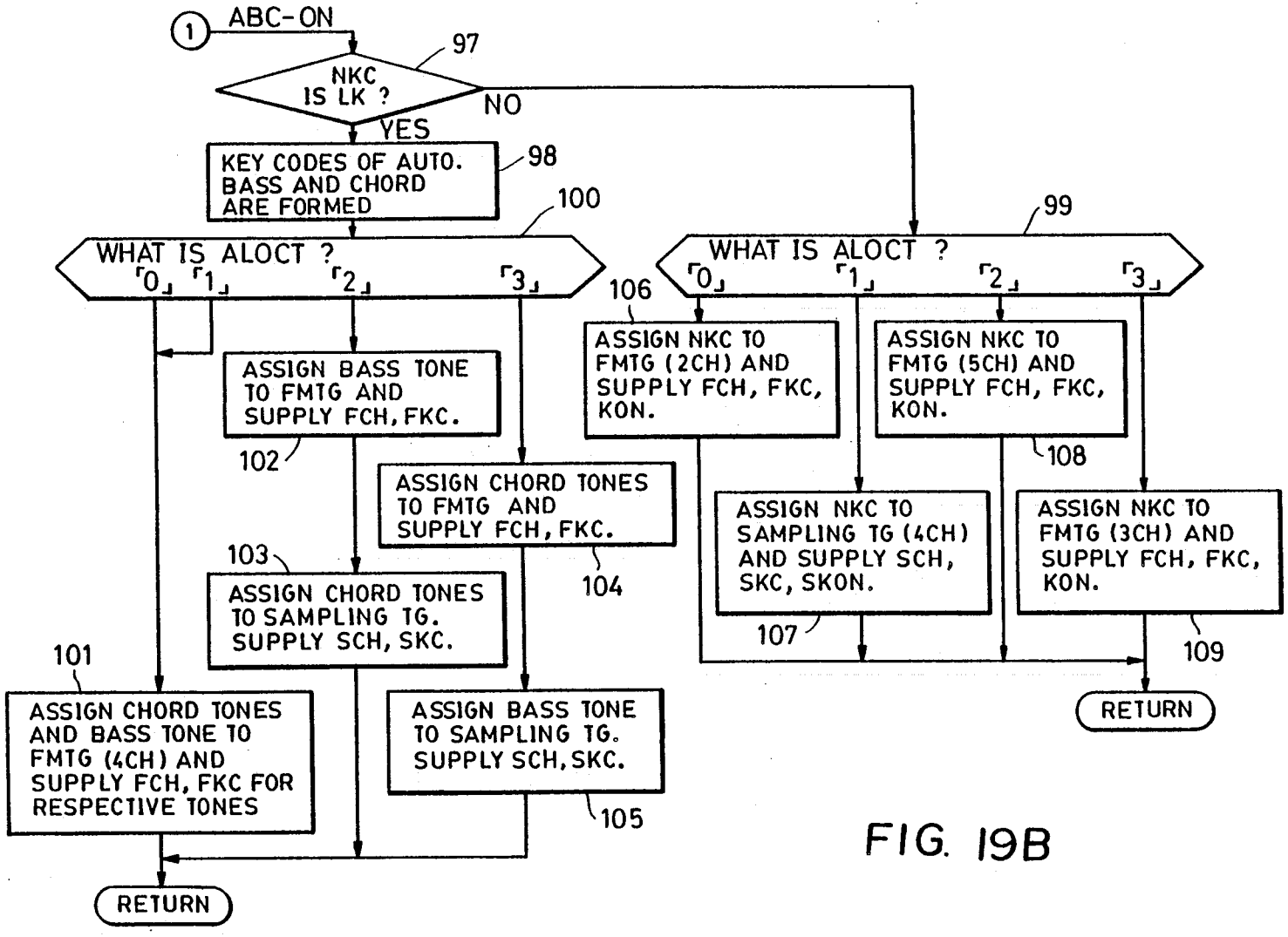

The key assigning operation in which sounding of a depressed key in the keyboard 14 is assigned to any of the channels is performed in accordance with Table 1 and this key assigning operation is achieved by executing a new-key-on event routine shown in FIGS. 19A and 19B.

When a new key has been depressed in the keyboard 14, the new-key-on event routine of FIGS. 19A and 19B are executed. In this routine, the key code of the newly depressed key is registered in the new key code regiser NKC (step 90). In next step 91, whether or not contents of the ABC register ABCRG are "0" is examined.

If ABC is OFF, the routine proceeds to step 92 in which the contents of the allocation regiser ALOCT are examined. When ALOCT is "0" or "3", i.e., the sampled tone is allocated to the "bass" part or is not allocated to any part, the routine proceeds to step 93. In this routine, an allocating operation which corresponds to the crossing point of "ABC=OFF" and "sampled tone allocation=ON" in Table 1 or an allocating operation which corresponds to the crossing point of "ABC=OFF" and "samled tone allocation=bass" in the table is executed. In other words, a processing for assigning a depressed key in the entire key range in the keyboard 14 to the FM tone generator 25 is executed. More specifically, a processing for assigning sounding of a tone corresponding to the new key code register NKC to any of six channels of the FM tone generator 25 is executed, the key code of the new key code register NKC is supplied as the key code FKC to the FM tone generator 25 and, simultaneously, the channel number FCH of the channel to which assigning of sounding of the tone has been decided and the key-on signal KON corresponding to this channel are supplied to the FM tone generator 25.

When ALOCT is "1", i.e., the sampled tone is to be allocated to the "melody" part, the routine proceeds to step 94 in which whether or not the key code of the new key code register NKC is one belonging to the upper key range UK is examined. If so, the routine proceeds to step 95 in which sounding of a tone corresponding to the new key code register NKC is assigned to any of four channels of the sampling tone generator 26, the key code of the new key code register NKC is supplied as the key code SKC to the sampling tone generator 26 and, simultaneously, the channel number SCH of the channel to which assignment of sounding of the tone has been decided and the key-on signal SKON corresponding to this channel are supplied to the sampling tone generator 26. Thus, when the sampled tone is to be allocated to the "melody" part, a tone signal corresponding to a depressed key in the upper key range UK is assigned to any of the channels of the sampling tone generator 26 and sounded therein. When a depressed key is one belonging to the lower key range LK, the routine proceeds from NO of step 94 to step 93 in which sounding of the depressed key is assigned to the FM tone generator 25. The processing in this step corresponds to the assigning operation of the crossing point of "ABC =OFF" and "sampled tone allocation=-melody" in Table 1.

When ALOCT is "2", i.e., the sampled tone is to be allocated to the "chord" part, the processing proceeds to step 96. In this step, whether or not the key code of the new key code register NKC is one belonging to the lower key range LK is examined. If so, the routine proceeds to step 95 in which a processing similar to the one described above is executed. If not, the routine proceeds to step 93 in which a processing similar to the one described above is executed. Thus, when the sampled tone is to be allocated to the "chord" part, a tone signal corresponding to a depressed key of the lower key range LK is assigned to any of the channels of the sampling tone generator 26 and sounded therein whereas a tone signal corresponding to a depressed key in the upper key range UK is assigned to the FM tone generator 25 and sounded therein. The processing in this step corresponds to an assignment operation at the crossing point of "ABC=OFF" and "sampled tone allocation=chord" in Table 1.

When ABC is ON, the routine proceeds from NO of step 91 to step 97 in which whether or not the key code of the new key code register NKC is one belonging to the lower key range LK is examined. If so, the routine proceeds to step 98 and subsequent steps in which an automatic bass tone and an automatic chord tone are formed in response to a depressed key in the lower key range LK and a predetermined key assignment is performed. If the key code of the new key code register NKC is one belonging to the upper key range UK, the routine proceeds to step 99 and subsequent steps in which a predetermined key assignment is performed with respect to a new depressed key in the upper key range UK.

In step 98, key codes of a bass tone and a chord tone are respectively formed with respect to all depressed keys in the lower key range LK. For example, the key code of a bass tone consists of a single tone and the key code of a chord tone consists of three tones. In next step 100, the contents of the allocation register ALOCT are examined.

When ALOCT is "0" or "1", i.e., the sampled tone is to be allocated to the "melody" part or is not allocated to any part, the routine proceeds to step 101. In this step, the bass tone which was formed in step 98 is assigned to one channel of the FM tone generator 25 and the chord tone which was formed in step 98 is assigned to three channels of the FM tone generator 25, the respective key codes of the assigned bass tone and chord tone are supplied to the FM tone generator 25 as the key code FKC and, simultaneously, the channel numbers FCH of the respective channels to which the assignment has been decided are supplied to the FM tone generator 25. The processing in this step corresponds to the assignment operation at the crossing point of "ABC=ON" and "sampled tone allocation=-melody".

When ALOCT is "2", i.e., the sampled tone is to be allocated to the "chord" part, the routine proceeds to step 102. In this step, sounding of the bass tone formed in the preceding step 98 is assigned to one channel of the FM tone generator 25 and the key code of the assigned bass tone is supplied as the key code FKC to the FM tone generator 25. Then, the routine proceeds to step 103 in which sounding of the three chord tones formed in the preceding step 98 is assigned to three channels of the sampling tone generator 26, the respective key codes of the assigned chord tones are supplied as the key code SKC to the sampling tone generator 26, and, simultaneously, the channel numbers SCH of the respective channels to which assignment of the chord tones has been decided are supplied to the sampling tone generator 26. The processing in this step corresponds to the assignment processing concerning LK at the crossing point of "ABC=ON" and "sampled tone allocation=chord" in Table 1.

When ALOCT is "3", i.e., the sampled tone is to be allocated to the "bass" part, the routine proceeds to step 104. In this step, sounding of the three chord tones formed in the preceding step 98 is assigned to the three channels of the FM tone generator 25, the respective key codes of the assigned chord tones are supplied as the key code FKC to the FM tone generator 25 and, simultaneously, the channel numbers FCH of the channels to which assignment of the chord tones has been decided are supplied to the FM tone generator 25. Then, the routine proceeds to step 105 in which sounding of the bass tone formed in the preceding step 98 is assigned to one channel of the sampling tone generator 26, the key code of the assigned bass tone is supplied as the key code SKC to the sampling tone generator 26 and, simultaneously, the channel number SCH of the channel to which assignment of the bass tone has been decided is supplied to the sampling tone generator 26. The processing in this step corresponds to the assignment concerning LK at the crossing point of "ABC=ON" and "sampled tone allocation=bass" in Table 1.

When the key code of the new key code register NKC is one belonging to the upper key range UK, the routine proceeds to step 99 in which the contents of the allocation register ALOCT are examined.

When ALOCT is "0", i.e., the sampled tone is not to be allocated to any part, the routine proceeds to step 106. In this step, sounding of a tone corresponding to the new key code register NKC is assigned to any of two channels of the FM tone generator 25. The key code of the new key code register NKC is supplied as the key code FKC to the FM tone generator 25 and, simultaneously, the channel number SCH of the channel to which assignment of the tone has been decided and the key-on signal KON corresponding to this channel are supplied to the FM tone generator 25. The processing in this step corresponds to the assignment concerning UK at the crossing point of "ABC=ON" and "sampled tone allocation=OFF" in Table 1.

When ALOCT is "1", i.e., the sampled tone is to be allocated to the "melody" part, the routine proceeds to step 107. In this step, sounding of a tone corresponding to the new key code register NKC is assigned to any of four channels of the sampling tone generator 26, the key code of the new key code register NKC is supplied as the key code SKC to the sampling tone generator 26 and, simultaneously, the channel number SCH of the channel to which assignment of the tone has been decided and the key-on signal SKON corresponding to this channel are supplied to the sampling tone generator 26. Thus, in the case of allocating a sampled tone to the "melody" part, a tone signal corresponding to a depressed key in the upper key range UK is assigned to any of the channels of the sampling tone generator 26 and sounded therein. The processing in this step corresponds to the assignment concerning UK at the crossing point of "ABC=ON" and "sampled tone allocation=melody" in Table 1.

When ALOCT is "2", i.e., the sampled tone is to be allocated to the "chord" part, the routine proceeds to step 108. In this step, sounding of a tone corresponding to the new key code register NKC is assigned to any of five channels of the FM tone generator 25, the key code of the new key code register NKC is supplied as the key code FKC to the FM tone generator 25 and, simultaneously, the channel number SCH of the channel to which assignment of the tone has been decided and the key-on signal of this channel are assigned to the FM tone generator 25. The processing in this step corresponds to the assignment concerning UK at the crossing point of "ABC=ON" and "sampled tone allocation=chord".

When ALOCT is "3", i.e., the sampled tone is to be allocated to the "bass" part, the routine proceeds to step 109. In this step, sounding of a tone corresponding to the new key code register NKC is assigned to any of three channels of the FM tone generator 25, the key code of the new key code register NKC is supplied as the key code FKC to the FM tone generator 25 and, simultaneously, the channel number FCH of the channel to which assignment of the tone has been decided and the key-on signal KON corresponding to this channel are supplied to the FM tone generator 25. The processing in this step corresponds to the assignment concerning UK at the crossing point of "ABC=ON" and "sampled tone allocation=bass" in Table 1.

During peformance of the keyboard 14, in accordance with the above described key assigning operation, tone signals are generated in the FM tone generator 25 and the sampling tone generator 26 in response to the depression of key on the keyboard 14 and the generated tones are sounded from the sound system 29.

Upon release of a key which has been kept depressed, a new-key-off event routine shown in FIG. 20 is executed. In this routine, the key code of the newly released key is registered in the new key code register NKC (step 110). In next step 111, whether or not the contents of the ABC register ABCRG are "0" is examined.

When ABC is OFF, the routine proceeds to step 112 in which the key codes of the tones which have been assigned to the respective channels of the FM tone generator 25 and the sampling tone generator 26 are compared with the key codes of the new key code register NKC to detect a channel in which the newly released key was assigned. In response to the detected channel, the key-off signal KOF or SKOF is produced.

When ABC is ON, the routine proceeds to step 113 in which whether or not the key code of the new key code register NKC is one belonging to the upper key range UK is examined. If so, the routine proceeds to step 112 in which the same processing as described above is executed. If not, the key code of the new key code register NKC, i.e., the newly released key, is a key depressed in the lower key range LK for designating the automatic bass tone and the automatic chord tone and the processing at the key release time is not effected with respect to this tone (since release of a key is unrelated with preparation of the automatic accompaniment tones), so that the routine proceeds to "return".

Automatic accompaniment

Upon generation of a tempo clock pulse from the tempo clock generator 32, a tempo clock interrupt routine shown in FIG. 21 is executed. In this routine, whether or not contents of the rhythm start/stop register RSTART are "1" is examined (step 114). The routine proceeds to next step 115 only when the automatic rhythm is working and the contents of the tempo counter TPCTR are increased by 1. In next step 116, rhythm pattern data of a rhythm selected in response to the rhythm code registered in the rhythm register RCODE is read out from the rhythm pattern memory 31*b* in response to tempo clock count data of the tempo counter TPCTR and supplied to the rhythm tone generator 27. The rhythm tone generator 27 generates a rhythm tone signal (percussion instrument tone signal) in response to the given rhythm pattern data.

In next step 117, whether or not contents of the ABC register ABCRG are "0", i.e., whether or not the automatic bass/chord performance function is off notwithstanding that the sampled tone is allocated to the "bass" part, is examined. If the result is NO, the routine proceeds to step 118 in which whether or not the contents of the ABC register ABCRG are "1" is examined. If the automatic bass/chord performance function is on, the routine proceeds to step 119 in which chord pattern data and bass pattern data of a rhythm selected in response to the rhythm code registered in the rhythm register RCODE are read out from the chord pattern memory 31*c* and the bass pattern memory 31*d* in response to the tempo clock count data of the tempo counter TPCTR. These data are supplied to the FM tone generator 25 and the sampling tone generator 26 as the key-on signal KON or SKON corresponding to the channel to which the automatic chord tone and the automatic bass tone are assigned. Thus, in the FM tone generator 25 and the sampling tone generator 26, the tone signals of the automatic chord tone and the automatic bass tone are generated at a sounding timing designated by the chord pattern and the bass pattern responsive to the selected rhythm.

Extra percussion function

When a sampled tone is allocated to the "bass" part but the automatic bass/chord performance function is off, step 117 of FIG. 21 is YES and the routine proceeds to step 120 in which a processing for the extra percussion function is executed. In this step, sampled tone pattern data selected in response to a rhythm code registered in the rhythm register RCODE is read out from the sampled tone pattern memory 31*e* in response to the tempo clock count data of the tempo clock counter TPCTR. This sampled tone pattern data designates tone pitch of the sampled tone to be generated with the key code and is generated at a timing at which the sampled tone is generated. In response to the sampled tone pattern data read out from the sampled tone pattern memory 31*e*, the key code SKC representing tone pitch of the sampled tone to be generated and the key-on signal SKON are supplied to the sampling tone generator 26 together with the channel number SCH designating a predetermined channel of the sampling tone generator 26 (this may be any desired channel).

In the foregoing manner, in the sampling tone generator 26, a tone signal having the tone pitch and sounding timing corresponding to the sampled tone pattern data read out from the sampled tone pattern memory 31*e* is generated. Accordingly, notwithstanding that a sampled tone normally is not sounded when the ABC function is off even if the sampled tone is allocated to the "bass" part, this "extra percussion function" enables a sampled tone to be automatically generated in response to a selected rhythm.

As examples of the sampled tone pattern according to the "extra percussion function", a sampled tone of tone pitch of A3 may be sounded at a sounding timing of a bass drum, a sampled tone of tone pitch of A4 may be sounded at a sounding timing of a snare drum and a sampled tone of a suitable tone pitch may be sounded at a sounding timing of a suitable other rhythm tone.

Modified embodiments

In the above described embodiment, as regards the automatic bass tone and the automatic chord tone, a sounding timing only is controlled in accordance with the pattern in step 119 of the tempo clock interrupt routine and tone pitch in each sounding timing is no controlled by the pattern. However, as in the usually known walking bass and arpeggio, tone pitch at respective sounding timings of the automatic bass tone and the automatic chord tone may of course be controlled in accordance with the pattern. In that case, for example, processings for forming and assigning the automatic bass tone and automatic chord tone similar to the processings in steps 98–105 in FIG. 19 may be executed in a step in the tempo clock interrupt routine in FIG. 20.

In the above described embodiment, when waveform sampled data of a tone signal generated by the FM tone generator 25 which is a built-in tone source is to be written in the data memory as a sampled tone, tone pitch of a tone signal generated by the FM tone generator 25 when this sampled tone is to be allocated to a part of normal tone range is made different from tone pitch when the sampled tone is to be allocated to the bass tone part so that, in sounding the sampled tone, the tone range of the read control circuit may be made narrower than a tone range in which a sampled tone can be sounded and the circuit construction thereby can be simplified. The same purpose can however be achieved by differing the write rate of the data memory 28 depending upon the two possibilities without changing the tone pitch of a tone signal generated by the FM tone generator 25. In a case where, for example, the sampled tone is to be allocated to the part of the normal tone range, i.e., "melody" or "chord" part, a reference write rate (i.e., a rate corresponding to A4 tone which is the reference tone pitch) is designated and in a case where the sampled tone is to be allocated to the "bass" part, a write rate which is higher by a predetermined note interval (e.g., one octave) than the reference write rate (i.e., rate of A5 tone) is designated. In the FM tone generator 25, a tone signal is generated at the same reference tone pitch (e.g., A4 tone) in both cases. For this purpose, for example, the processing of steps 62, 64 and 65 is modified as follows: In step 62, a key code of the reference tone pitch (A4 tone) is supplied as the key code FKC to a certain channel of the FM tone generator 25. In step 64 (when the sampled tone is to be allocated to the part of the normal tone range), a key code of the reference tone pitch (A4 tone) is supplied as the key code SKC to the channel 1 of the sampling tone generator 26. In step 65 (when the sampled tone is to be allocated to the bass part), a key code of tone pitch which is one octave higher than the reference tone pitch (A5 tone) is supplied as the key code SKC to the channel 1 of the sampling tone generator 26. By this arrangement, when the sampled tone is allocated to the bass part, if reading is performed during reading time in response to, for example, the key code SKC of A3 tone, a tone signal of A3 tone which is one octave lower is generated by the sampling tone generator 26.

The same purpose can be achieved by combining the control of the tone pitch of a tone generated by the FM tone generator 25 which is the built-in tone source and the control of the write rate in the sampling tone generator 26.

Whichever control method may be employed, note interval difference in the tone pitch of tone signals written in the data memory 28 of the sampling tone generator 26 between a case where the sampled tone is allocated to the part of the normal tone range and a case where the sampled tone is allocated to the bass tone part is not limited to one octave but may be two octaves or more or may be other predetermined note interval.

The built-in tone source means in the above embodiment synthesizes a tone signal by the FM system. The built-in tone source means however is not limited to this but may employ any other tone generation system.

In the above described embodiment, the write rate in sampling a tone signal from an external tone signal or from a built-in tone source in the sampling tone generator is automatically set to a predetermined reference tone pitch (A4 tone). The write rate however may be set as desired by the performer by a tone pitch setting operation on the keyboard or the like means.

In the example of FIG. 4, an analog tone signal generated by the FM tone generator 25 which is a built-in tone source is sampled in the data memory 28 after analog-to-digital conversion. Alternatively, a digital tone signal before digital-to-analog conversion may be picked up in the FM tone generator 25 and this tone signal may be applied to the data memory 28. Conversely, a tone signal which has been generated by the FM tone generator 25 and sounded through the sound system 29 may be picked up by the microphone 16 and applied to the data memory 28 through a route from the microphone 16.

In the above described embodiment, the bass tone part is automatically played as the automatic bass tone in the automatic bass/chord performance. Alternatively, the bass tone part may be manually played (e.g., a tone of a depressed key in a predetermined keyboard or a key range may be generated as a tone of the bass tone part).

The operators in the operator panel section 15 need not be made of push-button type switches but may be of any type or operation form. There may also be provided a display which displays current operation states of the respective operators.

In the above described embodiment, the various operations are performed by the software processings using the microcomputer. Alternatively, these operations may be performed by using a hardware circuit exclusively adapted to the purpose of this invention.

When the mode is automatically changed to the internal tone sampling mode on condition that a tone signal from outside has not been applied for a predetermined period of time, the operation time of the timer 30 which counts this predetermined period of time is set at ten seconds in the above described embodiment. The operation time is not limited to this but it may be set at other suitable length of time. Instead of providing the timer circuit as a hardware circuit as in this embodiment, counting of the operation time may be effected by a timer interrupt processing by a software program.

In the above described embodiment, the tone pitch adjustment of a sampled tone (tuning) is made by controlling the generation frequency of the master clock generator 44 of the sampling tone generator 26. The tone pitch adjustment however is not limited to this but any suitable method may be employed for the tone pitch adjustment. The amount of fine tone pitch adjustment is not limited to one cent but any suitable value may be adopted.

As regards the "reference tone sounding tuning function", it is not essential that a tone which becomes an object of the tone pitch adjustment (tuning) should be a sampled tone. It is only enough if, when the tone pitch adjustment (tuning) is performed, a tone from a tone source which is currently subjected to the tone pitch adjustment is sounded in a state adjusted in tone pitch at a predetermined tone pitch and a tone of a reference tone pitch of a normal pitch which is not adjusted in tone pitch is simultaneously sounded. In this case, the same tone source circuit may be used in two channels on a time shared basis in such a manner that the tone of the predetermined tone pitch is sounded in the tone pitch adjusted state in one channel and the tone of the reference tone pitch is sounded at the normal pitch in the other channel. The tone of the reference tone pitch sounded at the normal pitch and the tone of the predetermined tone pitch sounded in the tone pitch adjusted need not be of the same tone pitch (note name) but, for example, may be of the same note name but of different octaves.

In the above described embodiment, the "reference tone sounding tuning function" becomes effective by turning on the increase switch INC or decrease switch DEC while pushing the pitch switch PS. The "reference tone sounding tuning function" however may become effective by any other manner of operation. For example, the "reference tone sounding tuning function" may become effective when the pitch switch PS is turned on after the increase switch INC or the decrease switch DEC is turned on. Further, the tone of the reference tone pitch sounded at the normal pitch and the tone of the predetermined tone pitch sounded in the tone pitch adjusted state need not be sounded completely simultaneously but they may be sounded alternately. Alternatively, the tone of the reference tone pitch may be sounded during pushing of the pitch switch PS and sounding of the tone of the tone pitch adjusted state only may be sustained upon release of the pitch switch PS. Alternatively further, other exclusive switches may be used without using the pitch switch PS, increase switch INC and decrease switch DEC.

In the above described embodiment, the tone pitch adjustment by half tone for transposition is performed by changing the value of the key code by the transposition circuits 35 and 43. This tone pitch adjustment may however be performed by other means.

In FIG. 4, the sampling enable signal SPEN is applied to the master clock generator 44 to prohibit tone pitch adjustment in the sampling tone generator 26 during the sampling mode so that the write rate becomes the normal pitch of the reference tone pitch (A4 tone). The transposition circuits 35 and 43 however are not so constructed that the transposition operation is prohibited by the sampling enable signal SPEN. However, transposition circuits 35 and 43 may also be so constructed that the transposition operation is prohibited during writing of a sampled tone by the sampling enable signal SPEN.

In the above described embodiment, transposition of a sampled tone only is performed by turning on the up switch UPS or down switch DWS while pushing the pitch switch PS. The transposition of a sampled tone only may be made by other suitable operation. Other suitable exclusive switches may be used without using the pitch switch PS, the up switch UPS and the down switch DWS.

In the above described embodiment, the "extra percussion function", i.e., the function in which the sampled tone is automatically sounded at a tone pitch and sounding timing pattern responsive to the rhythm, becomes effective when the automatic bass/chord performance is off and the sampled tone is allocated to the part of "bass". This function however is not limited to this but it may be worked under any other condition or mode or by other switch operation. The arrangement may be modified in such a manner that, when the sampled tone is automatically performed in accordance with this function, the sampled tone is sounded simultaneously by operation of the keyboard or the like by the performer.

As described in the foregoing, according to the invention present, one of a tone signal from outside and a tone signal generated by a built-in tone source can be selectively sampled and stored in a memory provided exclusively for sampled tones so that processings which are the same as are applied to a tone signal sampled from outside, i.e., a sampled tone editing processing and other processings, can be applied to the tone signal from the built-in tone source. In other words, the function as the tone signal generation device of the sampling system can be applied to a tone signal from a built-in tone source whereby the sampling function can be expanded.

Further, according to the present invention, when a tone signal generated by a built-in tone source is sampled and stored in a memory for sampling, the writing control of a sampled tone is made in consideration of a performance part using a sampled tone signal, i.e., a sampled tone in a second part (e.g., a part of lower tone range such as bass tones) whose main tone range is different from a normal tone range is written in the memory at a tone pitch which is different from a sampled tone of a part of normal tone range (e.g., in case that the second part is a part of the lower tone range such as bass tones, at a tone pitch which is lower than the sampled tone of the part of the normal tone range) so that, as regards the sampled tone of a part of lower tone range such as bass tones, a tone of a tone pitch which is substantially lower than the tone pitch at which a read rate is designated (bass tone) can be generated. As regards a sampled tone of a part of a higher tone range, a tone of a tone pitch which is substantially higher than a tone pitch at which a read rate is designated can be generated. Accordingly, even if the read control circuit is a sample one adapted for a relatively narrow tone range, a tone can be generated with a sufficient tone range which has been substantially expanded during reading and performance.

Furthermore, according to the present, when an external tone signal has not been applied for a predetermined period of time after start of sampling of an external tone, a tone signal is generated by the built-in tone source and this tone signal is sampled and stored in the memory means. Accordingly, even when an external tone has not been sampled in the memory means for some reason notwithstanding that sampling of the external tone has once been designated, the tone signal generated by the built-in tone source is automatically stored in the memory means so that when a performer who is not aware of his erroneous operation or failure in sampling of the external tone starts playing on the keyboard for the purpose of performing a sampled tone, a tone can be generated by depression of a key without any problem so that performance of a sampled tone can be made smoothly without causing the performer to misunderstand that the device is out of order.

What is claimed is:

1. A tone signal generation device, comprising:

tone sampling means for sampling a tone waveform signal applied from outside;

built-in tone source means responsive to tone pitch information for generating a tone waveform signal independent of said tone waveform signal applied from outside and having tone pitch corresponding to the tone pitch of the tone pitch information;

memory means capable of both writing and reading for storing waveform sampled data of said tone waveform signal generated by said tone sampling means and waveform sampled data of said tone waveform signal generated by said built-in tone source means;

write control means for selecting one of waveform sampled data of a tone waveform signal sampled by said tone sampling means and waveform sampled data of a tone waveform signal generated by said built-in tone source means and writing the selected waveform sampled data in said memory means;

tone pitch designation means for designating tone pitch of a tone to be generated; and read control means for reading out the waveform sampled data from said memory means in accordance with the tone pitch designated by said tone pitch designation means;

wherein said tone signal generation device generates a tone signal corresponding to the waveform sampled data read out from said memory means.

2. A tone signal generation device as defined in claim 1, further comprising:

allocation setting means for setting at least one of a first performance part having a normal tone range and a second performance part having a tone range whose main tone range is different from the tone range of the first performance part as a performance part to which the waveform sampled data stored in said memory means should be allocated as tone source data; and tone pitch information supply means for supplying the tone pitch information to said built-in tone source means in such a manner that, when the waveform sampled data of said memory means is allocated to said second performance part in accordance with setting by said allocation setting means, said tone pitch information supply means supplies tone pitch information which is different by a predetermined note interval from tone pitch information supplied when the waveform sampled data is allocated to said first performance part;

wherein the tone pitch of a tone waveform signal generated by said built-in tone source means and written in said memory means differs by the predetermined note interval when the waveform sampled data is allocated to said second performance part from the tone pitch generated when the waveform sampled data is allocated to said first performance part and, as a result, when the waveform sampled data is allocated to said second performance part, tone pitch of a tone signal corresponding to waveform sampled data read out from said memory means in accordance with the tone pitch designated by said tone pitch designation means is different by the predetermined note interval from the designated tone pitch.

3. A tone signal generation device as defined in claim 2 wherein said second performance part is a performance part of bass tones and, when the waveform sampled data of said memory means is allocated to said second performance part, the tone pitch information supplied from said tone pitch information supply means to said built-in tone source means is lower by a predetermined note interval from tone pitch information supplied when the waveform sampled data is allocated to said first performance part.

4. A tone signal generation device as defined in claim 1, further comprising:

allocation setting means for setting at least one of a first performance part having a normal tone range and a second performance part having a tone range whose main tone range is different from the tone range of the first performance part as a performance part to which the waveform sampled data stored in said memory means should be allocated as tone source data; and write rate designation means for designating a write rate for writing a waveform sampled data of a tone waveform signal generated by said built-in tone source means in said memory means in such a manner that, when the waveform sampled data of said memory means is allocated to said second performance part in accordance with setting by said allocation setting means, said write rate designation means designates a write rate which is different by a predetermined note interval from a reference write rate designated when the waveform sampled data is allocated to said first part;

whereby when the waveform sampled data of said memory means is allocated to said second performance part, tone pitch of a tone signal corresponding to waveform sampled data read out from said memory means in accordance with the tone pitch designated by said tone pitch designation means is different by the predetermined note interval from the designated tone pitch.

5. A tone signal generation device as defined in claim 4 wherein said second performance part is a performance part of bass tones and, when the waveform sampled data of said memory means is allocated to said second performance part, the write rate designated by said write rate designation means to said memory means is higher by a predetermined note interval from a write rate designated when the waveform sampled data is allocated to said first performance part.

6. A tone signal generation device as defined in claim 1, further comprising editing processing means for subjecting the waveform sampled data stored in said memory means to a desired tone editing processing.

7. A tone signal generation device, comprising:

a tone signal input means for receiving a tone waveform signal from outside;

built-in tone source means responsive to information which designates generation of a tone for generating a tone waveform signal;

memory means capable of both writing and reading for storing waveform sampled data of a tone waveform signal received through said tone signal input means or waveform sampled data of a tone waveform signal generated by said built-in tone source means;

sampling demand means for demanding inputting of a tone waveform signal from said tone signal input means and writing waveform sampled data of the input tone waveform signal in said memory means;

rise detection means for detecting rising of the tone waveform signal received through said tone signal input means;

sampling control means for designating, when rise of the tone waveform signal has not been detected by said rise detection means within a predetermined period of time from the demand of writing of the waveform sampled data by said sampling demand means, generation of a tone waveform signal from said built-in tone source means and writing of waveform sampled data of the generated tone waveform signal in said memory means; and read means for reading out the waveform sampled data stored in said memory means and thereby generating a tone signal corresponding to the read out waveform sampled data.

8. A tone signal generation device, comprising:

tone generation means for generating a tone signal;

pitch adjusting operator means for adjusting pitch of a tone signal generated by said tone generation means;

pitch adjustment control means for enabling pitch adjustment to be made by said tone generation means in response to operation of said pitch adjusting operator means;

reference tone generation means for generating a reference tone signal having a predetermined reference pitch;

selection switch means for selecting whether the reference tone signal should be sounded or not;

detection means for detecting operation of said pitch adjusting operator means in association with operation of said selection switch; and tone sounding control means responsive to detection by said detection means for automatically generating the reference tone signal from said reference tone generation means and sounding the generated reference tone.

9. A tone signal generation device as defined in claim 8 wherein said tone sounding control means causes a tone signal under pitch adjustment to be automatically generated from said tone generation means and sounded in response to detection by said detection means.

10. A tone signal generation device as defined in claim 9 wherein a target pitch of a tone signal under pitch adjustment which is automatically generated by said tone generation means is said reference pitch.

11. A tone signal generation device as defined in claim 8, further comprising control means for causing, when pitch adjustment in said tone generation means is made by said pitch adjustment control means in response to operation of said pitch adjusting operator means, a tone signal under pitch adjustment to be generated automatically from said tone generation means and sounded.

12. A tone signal generation device as defined in claim 11 wherein a target pitch of a tone signal under pitch adjustment which is automatically generated by said tone generation means is said reference pitch.

13. A tone signal generation device as defined in claim 8 wherein said tone generation means includes memory means for storing waveform sampled data corresponding to a tone signal applied from outside and generates a tone signal on the basis of the waveform sampled data stored in said memory means.

14. A tone signal generation device, comprising:

tone sampling means for sampling a tone waveform signal applied from outside;

sampled tone source means having memory means for storing waveform sampled data corresponding to the tone waveform signal sampled by said tone sampling means for generating a tone signal on the basis of the waveform sampled data stored in said memory means;

built-in tone source means comprising a prepared tone source for generating a tone waveform signal;

pitch adjusting operator means for adjusting pitch of a tone waveform signal generated by at least one of said sampled tone source means and said built-in tone source means;

mode selection means for selecting one of a first mode in which pitch adjustment is made by both said sampled tone source means and said built-in tone source means and a second mode in which pitch adjustment is made by only said sampled tone source means; and pitch adjustment control means for performing pitch adjustment in such a manner that, when the first mode has been selected, pitch adjustment is made in both said sampled tone source means and said built-in tone source means in response to operation of said pitch adjusting operator means and, when the second mode has been selected, pitch adjustment is made in only said sampled tone source means in response to operation of said pitch adjusting operator means.

15. A tone signal generation device, comprising:

tone sampling means for sampling a tone waveform signal applied from outside;

sampled tone source means having memory means for storing waveform sampled data corresponding to the tone waveform signal sampled by said tone sampling means for generating a tone signal on the basis of the waveform sampled data stored in said memory means;

tempo signal generation means for generating a tempo signal;

sampled tone pattern generation means responsive to the tempo signal generated by said tempo signal generation means for generating pattern data designating tone sounding timing and tone pitch of a tone signal to be generated in said sampled tone source means;

tone pitch designation means for manually designating tone pitch of a tone to be generated; and select means for selecting one of an output of said tone pitch designation means and an output of said sampled tone pattern generation means to be allocated to said sampled tone source means;

control means for controlling the allocating of the output of one of said sampled tone pattern generation means and said tone pitch designation means to said sampled tone source means in accordance with a selection of said select means.

16. A tone signal generation device as defined in claim 15, further comprising rhythm selection means and in which said pattern generation means generates the pattern data in accordance with a rhythm selected by said rhythm selection means.

17. A tone signal generation device as defined in claim 15, further comprising bass pattern generation means for generating an automatic bass/chord performance pattern in response to the tempo signal generated by said tempo signal generation means and in which said control means performs control in such a manner that, when an automatic bass performance has been selected in a performance mode in which said sampled tone source means is used for bass tones, said sampled tone source means is driven in accordance with the outputs of said tone pitch designation means and said bass pattern generation means whereas, when the automatic bass performance has not been selected in a performance mode in which said sampled tone source means is used for bass tones, said sampled tone source means is driven in accordance with the output of said sampled tone pattern generation means.

18. A tone signal generation device as defined in claim 15, further comprising:

rhythm pattern generation means for generating rhythm pattern data in response to the tempo signal generated by said tempo generation means; and rhythm tone source means for generating a rhythm tone signal in response to the rhythm pattern data generated by said rhythm pattern generation means.

* * * * *